US010272683B2

(12) United States Patent
Togashi et al.

(10) Patent No.: US 10,272,683 B2
(45) Date of Patent: Apr. 30, 2019

(54) FLOW PATH STRUCTURE, LIQUID EJECTING HEAD, AND LIQUID EJECTING APPARATUS

(71) Applicant: SEIKO EPSON CORPORATION, Tokyo (JP)

(72) Inventors: Isamu Togashi, Matsumoto (JP); Hiroaki Okui, Azumino (JP); Yasuyuki Kudo, Shiojiri (JP); Fujio Akahane, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/143,928

(22) Filed: Sep. 27, 2018

(65) Prior Publication Data

US 2019/0023015 A1 Jan. 24, 2019

Related U.S. Application Data

(63) Continuation of application No. 15/625,068, filed on Jun. 16, 2017, now Pat. No. 10,124,586, which is a (Continued)

(30) Foreign Application Priority Data

Mar. 17, 2014 (JP) ..... 2014-053757
Mar. 17, 2014 (JP) ..... 2014-053758

(51) Int. Cl.
*B41J 2/14* (2006.01)

(52) U.S. Cl.
CPC ..... *B41J 2/14233* (2013.01); *B41J 2/1433* (2013.01); *B41J 2002/14306* (2013.01); (Continued)

(58) Field of Classification Search
CPC .... B41J 2002/14362; B41J 2002/14306; B41J 2202/20; B41J 2/155; B41J 2/17556
See application file for complete search history.

(56) References Cited

U.S. PATENT DOCUMENTS 4,911,616 A 3/1990 Laumann
6,250,738 B1 * 6/2001 Waller ..... B41J 2/14024 347/13

(Continued)

FOREIGN PATENT DOCUMENTS

JP 2003145752 A 5/2003
JP 2004284293 10/2004

(Continued)

OTHER PUBLICATIONS

Notice of Allowance issued in U.S. Appl. No. 15/625,068 dated Aug. 8, 2018.

(Continued)

*Primary Examiner* — John Zimmermann
(74) *Attorney, Agent, or Firm* — Workman Nydegger

(57) ABSTRACT

A flow path structure includes: a substrate that includes a first surface and a second surface on a side opposite to the first surface; a supply port formed on the first surface; a plurality of discharge ports formed on the second surface; grooves that are formed on the first surface so as to extend in an X direction and communicate with the supply ports and with the plurality of discharge ports via through-holes formed on the substrate; and a sealing portion that is disposed on the first surface and seals each groove.

19 Claims, 14 Drawing Sheets

Related U.S. Application Data continuation of application No. 15/074,879, filed on Mar. 18, 2016, now Pat. No. 9,707,760, which is a continuation of application No. 14/638,739, filed on Mar. 4, 2015, now Pat. No. 9,346,269.

(52) U.S. Cl.
CPC ..... *B41J 2002/14362* (2013.01); *B41J 2002/14419* (2013.01); *B41J 2002/14491* (2013.01)

(56) References Cited

U.S. PATENT DOCUMENTS

| | | | |
|---|---|---|---|
| 6,250,747 | B1 | 6/2001 | Hauck |
| 6,409,323 | B1 | 6/2002 | Silverbrook |
| 6,685,307 | B2 | 2/2004 | Dowell et al. |
| 7,164,436 | B2 | 1/2007 | Kumagai et al. |
| 8,057,015 | B2 | 11/2011 | Oguchi |
| 8,079,683 | B2 | 12/2011 | Silverbrook |
| 9,346,269 | B2 | 5/2016 | Akahane et al. |
| 2002/0033861 | A1 | 3/2002 | Boyd et al. |
| 2003/0234843 | A1 | 12/2003 | Liu |
| 2004/0080559 | A1 | 4/2004 | Fujimoto et al. |
| 2007/0076049 | A1 | 4/2007 | Cho et al. |
| 2007/0229596 | A1* | 10/2007 | Chikamoto ..... B41J 2/14209 347/50 |
| 2008/0165224 | A1 | 7/2008 | Akahane et al. |
| 2009/0141062 | A1 | 6/2009 | Takano et al. |
| 2009/0295882 | A1 | 12/2009 | Hagiwara |
| 2010/0073433 | A1 | 3/2010 | Shimizu et al. |
| 2012/0182354 | A1 | 7/2012 | Akahane et al. |
| 2014/0146112 | A1 | 5/2014 | Murray |
| 2014/0368580 | A1 | 12/2014 | Ishimatsu et al. |
| 2016/0200100 | A1 | 7/2016 | Togashi et al. |
| 2016/0200114 | A1 | 7/2016 | Nanjo et al. |
| 2017/0282623 | A1 | 10/2017 | Togashi et al. |

FOREIGN PATENT DOCUMENTS

| | | | |
|---|---|---|---|
| JP | 2004284293 | A | 10/2004 |
| JP | 2004330717 | | 11/2004 |
| JP | 2005500926 | | 1/2005 |
| JP | 2005199692 | A | 7/2005 |
| JP | 2005313384 | A | 11/2005 |
| JP | 2007090693 | A | 4/2007 |
| JP | 2010-006052 | | 1/2010 |
| JP | 2010006049 | | 1/2010 |
| JP | 2010006052 | A | 1/2010 |
| JP | 2010023422 | | 2/2010 |
| JP | 2010030166 | A | 2/2010 |
| JP | 2010052256 | | 3/2010 |
| JP | 2011140131 | A | 7/2011 |
| JP | 2014034194 | A | 2/2014 |
| WO | 03020523 | | 3/2003 |

OTHER PUBLICATIONS

Office Action issued in U.S. Appl. No. 15/625,068 dated Mar. 9, 2018.
Office Action issued in U.S. Appl. No. 15/074,879 dated Jul. 5, 2016.
Office Action issued in U.S. Appl. No. 15/074,879 dated Nov. 23, 2016.
Notice of Allowance issued in U.S. Appl. No. 15/074,879 dated Mar. 20, 2017.
Notice of Allowance issued in U.S. Appl. No. 14/638,739 dated Jan. 21, 2016.
Office Action issued in U.S. Appl. No. 14/638,739 dated Oct. 2, 2015.

* cited by examiner

FLOW PATH STRUCTURE, LIQUID EJECTING HEAD, AND LIQUID EJECTING APPARATUS

CROSS REFERENCES TO RELATED APPLICATIONS

This application is a continuation application of U.S. patent application Ser. No. 15/625,068, filed Jun. 16, 2017, which is a continuation application of U.S. patent application Ser. No. 15/074,879, filed Mar. 18, 2016, which issued as U.S. Pat. No. 9,707,760 on Jul. 18, 2017, which is a continuation application of U.S. patent application Ser. No. 14/638,739, filed Mar. 4, 2015, which issued as U.S. Pat. No. 9,346,269 on May 24, 2016, which patent applications are incorporated herein by reference in their entireties. U.S. patent application Ser. No. 14/638,739 claims the benefit and priority to Japanese Patent Application No. 2014-053757 filed on Mar. 17, 2014 and Japanese Patent Application No. 2014-053758 filed on Mar. 17, 2014. The entire disclosures of Japanese Patent Application Nos. 2014-053757 and 2014-053758 are hereby incorporated herein by reference.

BACKGROUND

1. Technical Field

The present invention relates to a technology of ejecting a liquid such as an ink.

2. Related Art

A liquid ejecting head that ejects a liquid such as an ink from a plurality of nozzles is proposed in the related art. For example, JP-A-2004-330717 discloses a configuration in which a surface of a substrate on which a groove is formed is sealed with a film such that flow paths of an ink supplied to a liquid ejecting head or of air for pressurizing an ink cartridge are formed. In a technology according to JP-A-2004-330717, tubes are joined to a supply port or a discharge port formed on a side surface of a substrate and an ink or air supplied to the supply port from the tube on the supply side is discharged to the tube on the discharge side from the discharge port. In addition, JP-T-2005-500926 discloses a configuration in which a plurality of substrates are stacked and a flow path is formed between the substrates and an ink supplied to a flow path from a tube joined to a supply port (ink suction port) formed on a side surface of the substrate is divided into a plurality of inks. In addition, JP-A-2010-006049 discloses a liquid ejecting head that includes a plurality of heads, a wiring substrate, and a liquid flow path. The plurality of heads are fixed on a surface of a fixing plate (platform). The wiring substrate is a circuit substrate in which a wiring that transmits a drive signal to the plurality of heads is formed and faces the fixing plate interposing the plurality of heads therebetween. The liquid flow path is a flow path through which an ink supplied from the outside is distributed to the plurality of heads and is disposed between the plurality of heads and the wiring substrate.

However, in technologies according to JP-A-2004-330717 and JP-T-2005-500926, since the supply port and the discharge port are formed on the side surfaces of the substrate for forming a flow path and a tube is joined from the side surfaces so as to protrude, there is a problem in that it is difficult to reduce a size of the liquid ejecting head when viewed in a direction perpendicular to the substrate.

In addition, in a technology according to JP-A-2010-006049, since the liquid flow path needs to be disposed in a space between the wiring substrate and the plurality of heads, there is a problem in that, particularly in a configuration in which a large number of flow paths of liquid flow paths or a large number of branches of liquids are formed, it is difficult to reduce a size of the liquid flow path (furthermore, a size of the liquid ejecting head) when viewed in a direction perpendicular to the wiring substrate. Although the wiring substrate is focused on in the above description, similar problems can arise also in a configuration in which the liquid flow path is disposed between an element such as a mechanism (for example, a self-sealing valve for producing negative pressure) for controlling a filter for removing bubbles or foreign substances or the flow path of an ink and the plurality of heads.

SUMMARY

An advantage of some aspects of the invention is miniaturization of a liquid ejecting head.

According to a first aspect of the invention, a flow path structure includes: a plate-shaped base section; a supply port formed on one surface of the base section; and a plurality of discharge ports formed on the other surface of the base section. A flow path through which the supply port and the plurality of discharge ports communicate with each other is formed in the base section. In the above configuration, since the supply port is formed on one surface of the base section and the plurality of discharge ports are formed on the other surface of the base section, the flow path structure is decreased in size (furthermore, a size of a liquid ejecting head on which the flow path structure is mounted) when viewed from a direction perpendicular to the base section, compared to the technologies according to JP-A-2004-330717 and JP-T-2005-500926 in which a supply port and a discharge port are formed on the side surfaces of the substrate so as to join tubes to each other.

In the flow path structure according to the first aspect of the invention, the base section may include: a substrate that includes a first surface on which the supply port is formed and a second surface on which the plurality of discharge ports are formed; a first front-side groove that is formed on the first surface so as to extend in a first direction and communicates with the supply port and with the plurality of discharge ports via a through-hole formed on the substrate; and a film-like first sealing portion that is disposed on the first surface and seals the first front-side groove and thus, forms at least a part of the flow path. In the above aspect, since the film-like first sealing portion is disposed on the first surface of the substrate such that the flow path is formed, there is an advantage in that it is easier to achieve a thin flow path structure, for example, compared to a configuration in which a plurality of substrates are joined to each other such that a flow path is formed between the substrates.

In the flow path structure according to a preferred example of the first aspect, the base section may include: a rear-side groove that is formed on the second surface; and a film-like second sealing portion that is disposed on the second surface and seals the rear-side groove. The rear-side groove may communicate with the supply port via the through-hole formed on the substrate, and the first front-side groove may communicate with the rear-side groove via the through-hole formed on the substrate. In the above aspect, since the supply port communicates with the first front-side groove through the rear-side groove formed on the second surface of the substrate, there is an advantage in that it is easier to manufacture the substrate, for example, compared to a configuration in which a supply port communicates with the first front-side groove via a flow path inside a substrate.

In the flow path structure according to a preferred example of the first aspect, the base section may include: a second front-side groove formed on the first surface so as to extend in the first direction. Each of the first front-side groove and the second front-side groove may communicate with the rear-side groove via the through-hole formed on the substrate. For example, the first front-side groove and the second front-side groove may be positioned on the opposite sides to each other interposing the supply port therebetween in a plan view. In the above aspect, since the first front-side groove and the second front-side groove communicate with each other via the rear-side groove, there is an advantage in that it is possible to form a flow path in a wider range of the first direction.

In the flow path structure according to a preferred example of the first aspect, the substrate may be formed of a thermoplastic resin material and surfaces formed of the resin material on the first sealing portion and the second sealing portion may be welded to the substrate. In the above aspect, since the surfaces of each of the first sealing portion and the second sealing portion are welded to the substrate, there is an advantage in that it is easier to dispose the first sealing portion and the second sealing portion, for example, compared to a configuration in which the first sealing portion and the second sealing portion adhere to the substrate with an adhesive.

In the flow path structure according to a preferred example of the first aspect, the first sealing portion and the second sealing portion may be film-like members separate from each other. In the above aspect, since the first sealing portion and the second sealing portion are the film-like members separate from each other, there is an advantage in that it is easier to dispose the first sealing portion and the second sealing portion on the substrate, compared to a configuration in which the first sealing portion and the second sealing portion are continuous with each other.

In the flow path structure according to an aspect of the invention, the base section may include: a first substrate that has a first surface on which the supply port is formed; and a second substrate that has a second surface on which the plurality of discharge ports are formed. A first flow path surface on a side opposite to the first surface of the first substrate and a second flow path surface on a side opposite to the second surface of the second substrate may be joined to each other. The flow path may be formed of a groove formed on at least one of the first flow path surface and the second flow path surface. In the above aspect, since the flow path is formed by joining the first substrate and the second substrate to each other, there is an advantage in that it is possible to sufficiently secure a mechanical strength of the flow path, compared to the aspect described above in which the flow path is formed of the film-like sealing portion.

In the flow path structure according to a preferred example of the respective aspects (including both the first aspect and the second aspect) illustrated above, each of the plurality of discharge ports may be a tube-shaped portion that protrudes from the second surface, and one discharge port and another discharge port of the plurality of discharge ports may have different heights from each other with respect to the second surface. In the above aspect, since the discharge ports on the second surface have different heights from each other, in a process of fixing the flow path structure and a joining target to each other in a state in which each of the discharge ports is inserted into the supply port of the joining target, time points at which stress from each of the discharge ports acts on the joining target is temporally dispersed. Thus, there is an advantage in that it is possible to prevent the joining target from deformation or damage due to the stress from each of the discharge ports of the flow path structure.

In the flow path structure according to a preferred example of the invention, the supply port, the plurality of discharge ports, and flow paths from the supply port to the plurality of discharge ports may be formed for each of a plurality of fluids. In the above aspect, since the plurality of flow paths corresponding to different fluids are formed on the substrate, it is possible to distribute the plurality of fluids plurally.

In the flow path structure according to a preferred example of the invention, the plurality of fluids may include a liquid and a gas. The flow path of the liquid may extend linearly in a plan view and the flow path of the gas may be formed in a bent shape in a plan view so as to bypass an attachment hole for fixing the substrate. In the above aspect, the flow path of the liquid may extend linearly and the flow path of the gas may be formed in the shape so as to bypass the attachment hole. Thus, there is an advantage in that it is possible to form an attachment hole while resistance in the flow path of the liquid is lowered. The resistance in the flow path does not cause a particular problem even when the flow path of the gas is bent so as to bypass the attachment hole.

In the flow path structure according to a preferred example of the invention, the plurality of fluids may include a plurality of gases which are pressurized individually from each other. In the above aspect, since the plurality of gases which are pressurized individually from each other are distributed by the flow path structure, it is possible to utilize each of the plurality of gases separately for control (opening/closing or pressure adjustment) of the flow path of the liquid. The same or different kinds of gases are used as each of the plurality of gases. For example, the plurality of gases can be air.

In the flow path structure according to a preferred example of the first aspect, the plurality of fluids may include a first liquid, a second liquid, and a gas. A flow path of the gas may be positioned between a flow path of the first liquid and a flow path of the second liquid in a plan view. In the above aspect, there is an advantage in that it is possible to easily join the flow path structure to the joining target in which the supply port of the gas is formed between a supply port of the first liquid and a supply port of the second liquid.

According to a preferred example of a second aspect of the invention, a liquid ejecting head includes the flow path structure according to each of the above aspects. Specifically, the liquid ejecting head according to an aspect of the invention includes the flow path structure according to each of the aspects described above which distributes each of a plurality of fluids including a liquid and a gas; a flow path controlling section that controls a flow path of a liquid of each system obtained after being distributed by the flow path structure using a gas of each system obtained after being distributed by the flow path structure; and a liquid ejecting section that ejects the liquid which passed through the flow path controlling section, from a plurality of nozzles. According to each of the aspects described above, since the flow path structure is decreased in size, there is an advantage in that the liquid ejecting head is decreased in size.

In the liquid ejecting head according to a preferred example of the second aspect, the liquid ejecting section may include: a liquid distributing unit that distributes a liquid of each system which passed through the flow path controlling section; a plurality of ejection head units which eject a liquid of each system obtained after being distributed by the liquid distributing unit, from the plurality of nozzles in accordance with a drive signal; and a wiring substrate which is disposed between the flow path structure and the liquid distributing unit and on which a wiring that transmits the drive signal is formed. In the above aspect, the wiring substrate is disposed between the flow path structure and the liquid distributing unit. That is, the liquid is distributed on one side and the other side of the wiring substrate. Thus, for example, it is possible to decrease a size of the liquid ejecting head when viewed from a direction perpendicular to the wiring substrate, compared to a configuration in which the liquid flow path is disposed only between the wiring substrate and a plurality of ejection heads. In addition, there is an advantage in that a distance between each of the ejection head units and the wiring substrate is decreased, compared to a configuration in which both the flow path structure and the liquid distributing unit are disposed between the wiring substrate and the plurality of ejection head units.

In the liquid ejecting head according to a preferred example of the second aspect, the liquid distributing unit may include an opening corresponding to each of the plurality of ejection head units. Each of the plurality of ejection head units may include a flexible wiring substrate joined to the wiring substrate via the opening of the liquid distributing unit. In the above aspect, since the flexible wiring substrate of each ejection head unit is joined to the wiring substrate via the opening of the liquid distributing unit, there is an advantage in that a size required for the flexible wiring substrate is decreased (furthermore, the manufacturing cost is reduced).

According to a third aspect of the invention, a liquid ejecting head includes: a flat plate-shaped flow path structure that distributes each of a plurality of fluids including a liquid and a gas; a flow path controlling section that controls a flow path of a liquid of each system obtained after being distributed by the flow path structure using a gas of each system obtained after being distributed by the flow path structure; and a liquid ejecting section that ejects the liquid which passed through the flow path controlling section, from a plurality of nozzles. The liquid ejecting section includes a flat plate-shaped liquid distributing unit that distributes the liquid of each system which passed through the flow path controlling section, and a plurality of ejection head units which eject the liquid of each system obtained after being distributed by the liquid distributing unit, from the plurality of nozzles in accordance with a drive signal. The flow path controlling section is positioned between the flow path structure and the liquid distributing unit which overlap with each other in a plan view. In the above aspect, since each of the plurality of fluids including the liquid and the gas is distributed by the flat plate-shaped flow path structure, it is possible to miniaturize the liquid ejecting head, compared to a configuration in which the liquid and the gas are distributed plurally by a separate mechanism. In addition, since the liquid of each system obtained after being distributed by the flow path structure is distributed plurally by the liquid distributing unit separated from the flow path structure, there is an advantage in that the liquid ejecting head is decreased in size when viewed from a direction perpendicular to the flow path structure, compared to a configuration in which the liquid is distributed by only a single element. The above advantage is remarkably effective in a configuration in which a great number of distributions are performed by the flow path structure or a liquid distributing unit (for example, a configuration in which the distribution number of a liquid by the flow path structure exceeds the number K of types of liquids, or a configuration in which the distribution number of a liquid by the liquid distributing unit exceeds the number K of types of liquids).

In the liquid ejecting head according to a preferred aspect of the invention, the liquid distributing unit may include a first flow path substrate, a second flow path substrate, and a third flow path substrate which are stacked. A first flow path through which a first liquid of the plurality of fluids is distributed to the plurality of ejection head units may be formed between the first flow path substrate and the second flow path substrate. A second flow path through which a second liquid of the plurality of fluids is distributed to the plurality of ejection head units may be formed between the second flow path substrate and the third flow path substrate. In the above aspect, since the first flow path is formed between the first flow path substrate and the second flow path substrate and the second flow path is formed between the second flow path substrate and the third flow path substrate, there is an advantage in that the liquid distributing unit is decreased in planar size, compared to a configuration in which both the first flow path and the second flow path are formed between a pair of substrates.

In the liquid ejecting head according to a preferred example of the invention, each of the plurality of ejection head units may include: a liquid storage chamber that stores a liquid obtained after being distributed by the liquid distributing unit; a plurality of pressure chambers which are filled with a liquid ejected from the nozzle; and a plurality of supply flow paths through which a liquid stored in the liquid storage chamber is supplied to the plurality of pressure chambers. In the above aspect, the liquid is distributed plurally by the flow path structure, the liquid obtained after being distributed by the flow path structure is distributed plurally by the liquid distributing unit, and the liquid after being distributed by the liquid distributing unit is distributed to the plurality of pressure chambers via each supply flow path.

In the liquid ejecting head according to a preferred example of the invention, the flow path structure may distribute the liquid to a plurality of discharge ports arranged along a first direction. The plurality of pressure chambers in each of the plurality of ejection head units are arranged along a second direction which is different from the first direction. In the above aspect, since the plurality of pressure chambers are arranged along the second direction which is different from the first direction along which the plurality of discharge ports of the flow path structure are arranged, it is possible to form the plurality of nozzles of each ejection head unit along the first direction in high density, for example, compared to a configuration in which the plurality of pressure chambers are arranged along the first direction.

According to an aspect of the invention, a liquid ejecting head includes a flow path structure that distributes a liquid; a liquid distributing unit that distributes a liquid of each system obtained after being distributed by the flow path structure; a plurality of ejection head units which eject the liquid of each system obtained after being distributed by the liquid distributing unit, from the plurality of nozzles in accordance with a drive signal; and a wiring substrate which is disposed between the flow path structure and the liquid distributing unit and on which a wiring that transmits the drive signal is formed. In the above aspect, the wiring substrate is disposed between the flow path structure and the liquid distributing unit. That is, the distribution of the liquid is executed on both sides between which the wiring substrate is interposed. Thus, it is possible to decrease the liquid ejecting head in size when viewed from a direction perpendicular to the wiring substrate, compared to the configuration according to JP-A-2004-330717 in which the liquid flow path is disposed only between the wiring substrate and the plurality of heads. In addition, there is an advantage in that the distance between each of the ejection head units and the wiring substrate is decreased, compared to a configuration in which both the flow path structure and the liquid distributing unit are disposed between the wiring substrate and the plurality of ejection head units.

According to a preferred example of the first aspect, each of the plurality of ejection head units may include: the flexible wiring substrate joined to the wiring substrate. According to the first aspect, since the distance between each of the ejection head units and the wiring substrate is decreased, there is an advantage in that a size required for the flexible wiring substrate for joining each of the ejection head units to the wiring substrate is decreased (furthermore, the manufacturing cost is reduced).

According to the second aspect of the invention, a liquid ejecting head includes a flow path structure that distributes a liquid; a liquid distributing unit that distributes a liquid of each system obtained after being distributed by the flow path structure; a plurality of ejection head units which eject a liquid of each system obtained after being distributed by the liquid distributing unit, from the plurality of nozzles; and a flow path controlling section that is disposed between the flow path structure and the liquid distributing unit and controls a flow path of a liquid of each system obtained after being distributed by the flow path structure. In the above aspect, the flow path controlling section is disposed between the flow path structure and the liquid distributing unit. That is, the distribution of the liquid is executed on both sides between which the flow path controlling section is interposed. Thus, it is possible to decrease the liquid ejecting head in size when viewed from a direction perpendicular to the flow path structure, compared to a configuration in which the liquid flow path is disposed only between the flow path controlling section and the plurality of ejection head units. In addition, there is an advantage in that it is possible to suppress a variation of a pressure drop in the flow path structure, compared to a configuration in which the flow path controlling section is disposed on the upstream side of the flow path structure.

According to the third aspect of the invention, a liquid ejecting head includes a flow path structure that distributes a liquid; a liquid distributing unit that distributes a liquid of each system obtained after being distributed by the flow path structure; a plurality of ejection head units which eject the liquid of each system obtained after being distributed by the liquid distributing unit, from the plurality of nozzles; and a filter section that includes a filter which is disposed between the flow path structure and the liquid distributing unit and through which a liquid of each system obtained after being distributed by the flow path structure passes. In the above aspect, the filter section is disposed between the flow path structure and the liquid distributing unit. That is, the distribution of the liquid is executed on both sides between which the filter section is interposed. Thus, it is possible to decrease the liquid ejecting head in size when viewed from a direction perpendicular to the flow path structure, compared to a configuration in which the liquid flow path is disposed only between the filter section and the plurality of ejection head units. In addition, since the filter section is disposed on the upstream side of the liquid distributing unit, there is an advantage in that there is a low possibility that bubbles or foreign substances flow in the liquid distributing unit. In a configuration in which the filter section and the liquid distributing unit are fixed to each other detachably, it is possible to easily perform cleaning of the filter section.

According to a fourth aspect of the invention, a liquid ejecting head includes a flow path structure that distributes a liquid; a liquid distributing unit that distributes a liquid of each system obtained after being distributed by the flow path structure; and a plurality of ejection head units which eject the liquid of each system obtained after being distributed by the liquid distributing unit, from the plurality of nozzles. Rigidity of the liquid distributing unit is higher than rigidity of the flow path structure. In the above aspect, since the flow path structure and the liquid distributing unit which distribute the liquid are configured to be separate from each other, it is possible to decrease the liquid ejecting head in size when viewed from a direction perpendicular to the flow path structure, compared to a configuration in which the liquid flow path is formed of a single element. In addition, since the rigidity of the liquid distributing unit is higher than the rigidity of the flow path structure, it is possible to effectively prevent the liquid distributing unit from deformation or damage. In a configuration in which a communication member, on which a through-hole that communicates with a flow path inside the liquid distributing unit is formed, is disposed so as to be in contact with the liquid distributing unit, since pressure from the communication member acts on the liquid distributing unit, the fourth aspect is particularly preferable, in which the liquid distributing unit is configured to have high rigidity such that the deformation or damage is suppressed.

According to a preferred example of each aspect described above, the flow path structure distributes the liquid to a plurality of discharge ports arranged along a first direction, and the plurality of liquid ejecting units including the liquid distributing unit and the plurality of ejection head units are arranged along the first direction. In the above aspect, since the plurality of liquid ejecting units are arranged along the first direction along which the plurality of discharge ports of the flow path structure are arranged, there is an advantage in that it is easy to dispose each liquid ejecting unit. In addition, in a configuration in which a casing is provided, which is disposed between the flow path structure and the liquid distributing unit and supports the plurality of liquid ejecting units, there is an advantage in that it is possible to sufficiently secure mechanical strength of the liquid ejecting head using the casing even in a case where the rigidity of the flow path structure is low.

In a preferred example of the liquid ejecting head according to each aspect of the invention, the flow path structure includes: a plate-shape base section; a supply port formed on one surface of the base section; and a plurality of discharge ports formed on the other surface of the base section. A flow path through which the supply port and the plurality of discharge ports communicate with each other is formed in the base section. In the above aspect, since the supply port is formed on one surface of the base section and the plurality of discharge ports are formed on the other surface of the base section, it is possible to decrease the flow path structure in size (furthermore, a size of a liquid ejecting head on which the flow path structure is mounted) when viewed from a direction perpendicular to the base section, compared to the a configuration in which a supply port and a discharge port are formed on the side surfaces of the substrate so as to join tubes to each other. According to a preferred aspect of the invention, the base section may include: a substrate that includes a first surface on which the supply port is formed and a second surface on which the plurality of discharge ports are formed; a first front-side groove that is formed on the first surface so as to extend in a first direction and communicates with the supply port and with the plurality of discharge ports via a through-hole formed on the substrate; and a film-like first sealing portion that is disposed on the first surface and seals the first front-side groove and thus, forms at least a part of the flow path. According to an aspect, the base section may include: a first substrate that has a first surface on which the supply port is formed; and a second substrate that has a second surface on which the plurality of discharge ports are formed. A first flow path surface on a side opposite to the first surface of the first substrate and a second flow path surface on a side opposite to the second surface of the second substrate is joined to each other. The flow path is formed of a groove formed on at least one of the first flow path surface and the second flow path surface.

A liquid ejecting apparatus according to a preferred aspect of the invention includes the liquid ejecting head according to each aspect described above. A preferred example of the liquid ejecting apparatus is a printing apparatus that ejects an ink; however, a usage of the liquid ejecting apparatus according to an aspect of the invention is not limited to printing.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
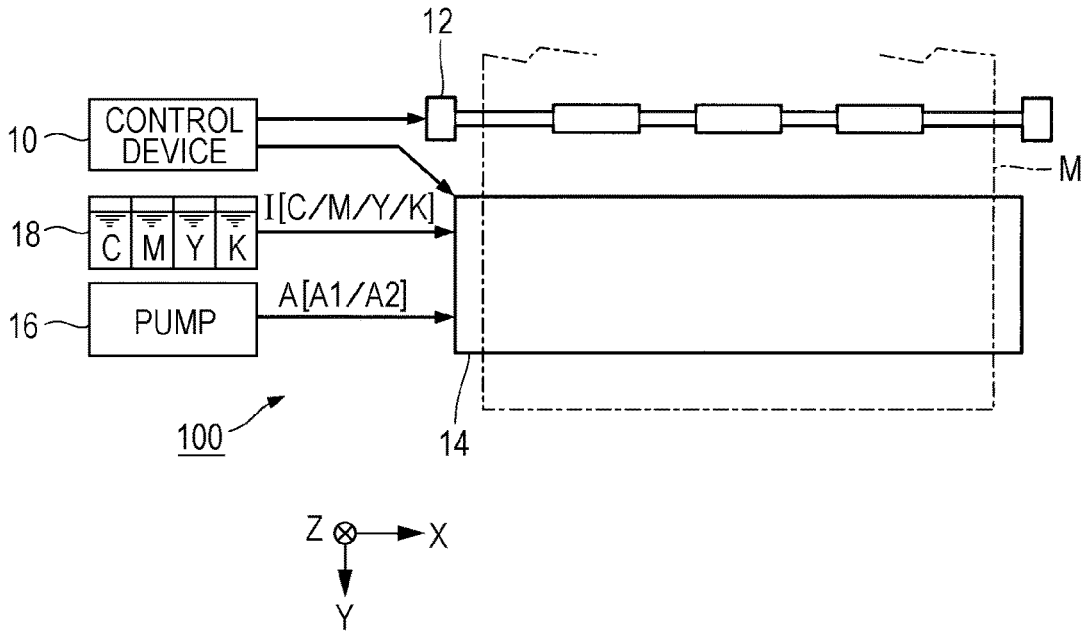
FIG. 1 is a diagram illustrating a configuration of a printing apparatus according to a first embodiment of the invention.

FIG. 1 is a diagram illustrating a partial configuration of an ink jet type printing apparatus 100 according to a first embodiment of the invention. The printing apparatus 100 according to the first embodiment is a liquid ejecting apparatus that ejects an ink as an example of a liquid onto a printing medium (ejection target) M such as a printing sheet and includes a control device 10, a transport mechanism 12, a liquid ejecting head 14, and a pump 16. A liquid container (ink cartridge) 18 which stores a plurality of colors of inks I is mounted on the printing apparatus 100. According to the first embodiment, four colors of cyan (C), magenta (M), yellow (Y), and black (B) inks I are stored in the liquid container 18.

The control device 10 controls every element of the printing apparatus 100 collectively. The transport mechanism 12 transports the printing medium M in a Y direction in accordance with control by the control device 10. The pump 16 is a gas supplying device that supplies air A of two systems (A1 and A2) to the liquid ejecting head 14 in accordance with control of the control device 10. The air A1 and air A2 are air used for control of a flow path inside the liquid ejecting head 14. The pump 16 according to the first embodiment can pressurize the air A1 and air A2 separately from each other. The liquid ejecting head 14 ejects an ink I supplied from the liquid container 18 onto the printing medium M in accordance with control by the control device 10. The liquid ejecting head 14 according to the first embodiment is a line head that is long in an X direction intersecting with the Y direction. A direction perpendicular to an X-Y plane (plane parallel to a surface of the printing medium M) is described as a Z direction, hereinafter. The ejection direction of the ink I by the liquid ejecting head 14 corresponds to the Z direction.

Figure 2:
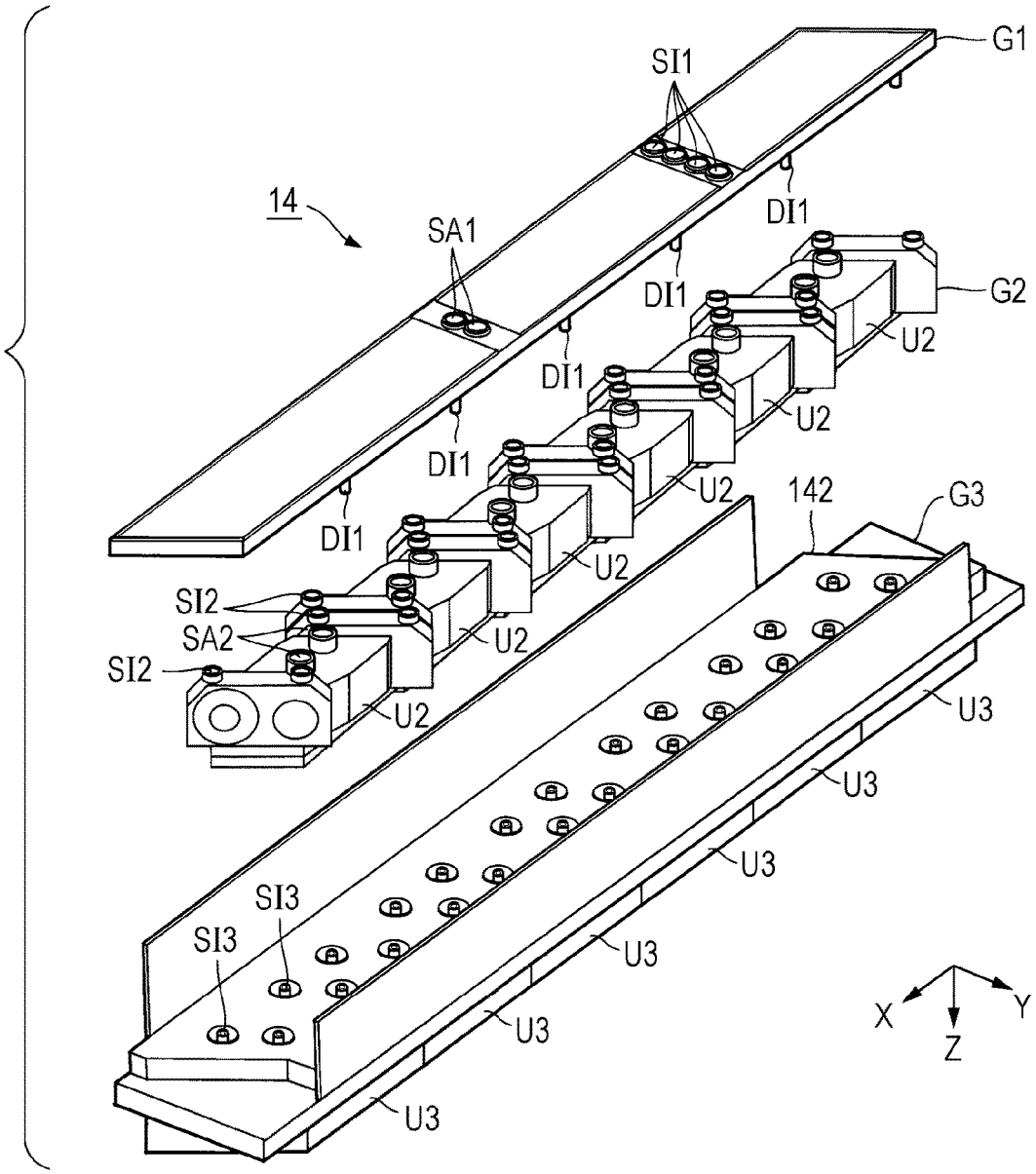
FIG. 2 is an exploded perspective view of a liquid ejecting head.
Figure 3:
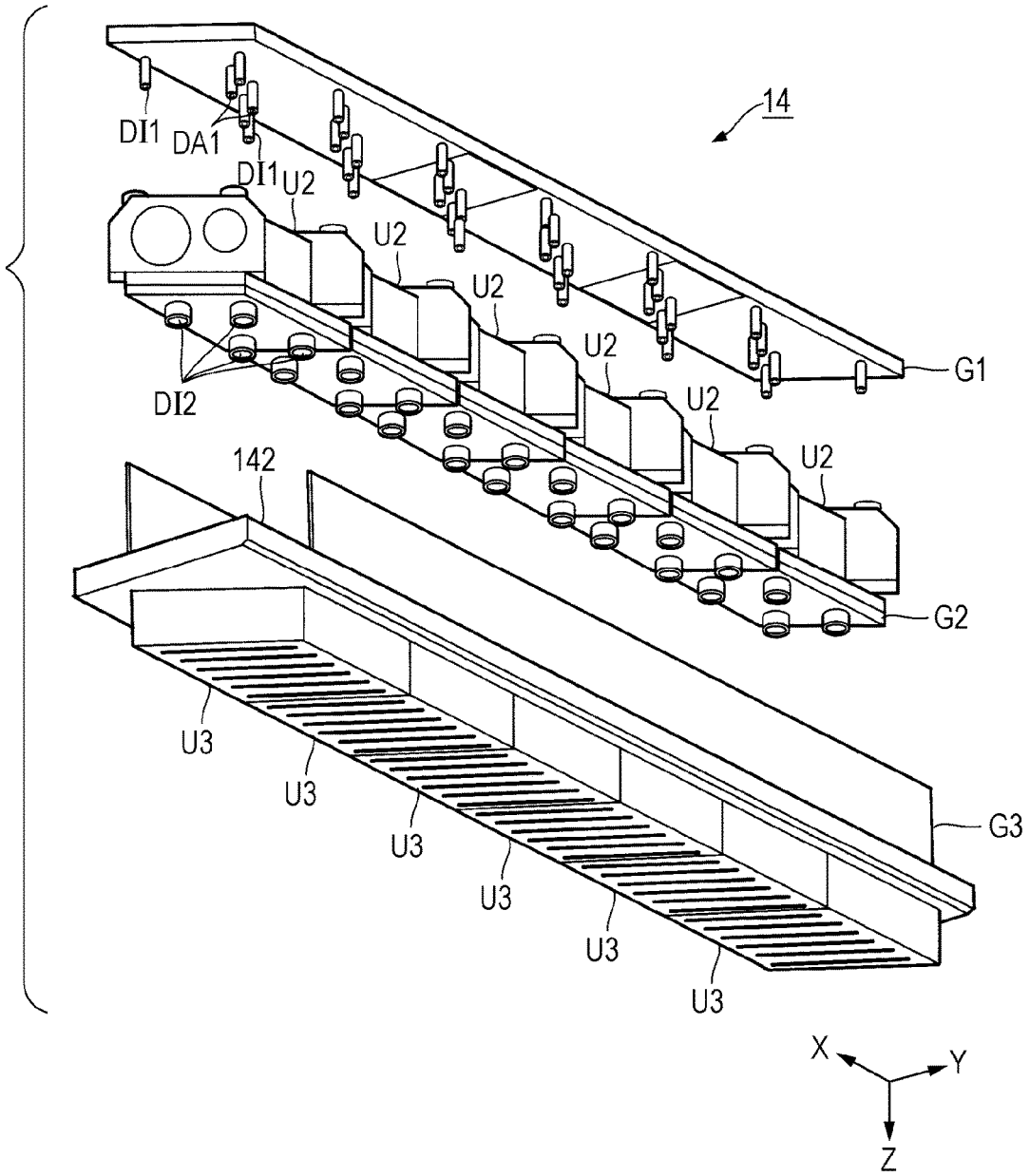
FIG. 3 is an exploded perspective view of the liquid ejecting head.

FIG. 2 and FIG. 3 are exploded perspective views of the liquid ejecting head 14. As illustrated in FIG. 2 and FIG. 3, the liquid ejecting head 14 according to the first embodiment is configured to have a flow path structure G1, a flow path controlling section G2, and a liquid ejecting section G3. Schematically, the flow path controlling section G2 is disposed between the flow path structure G1 and liquid ejecting section G3. That is, the flow path structure G1, the flow path controlling section G2, and the liquid ejecting section G3 overlap with one another when viewed from the Z direction. The liquid ejecting section G3 is a structure that accommodates six liquid ejecting units U3 in a casing 142 and supports the liquid ejecting units.

Figure 4:
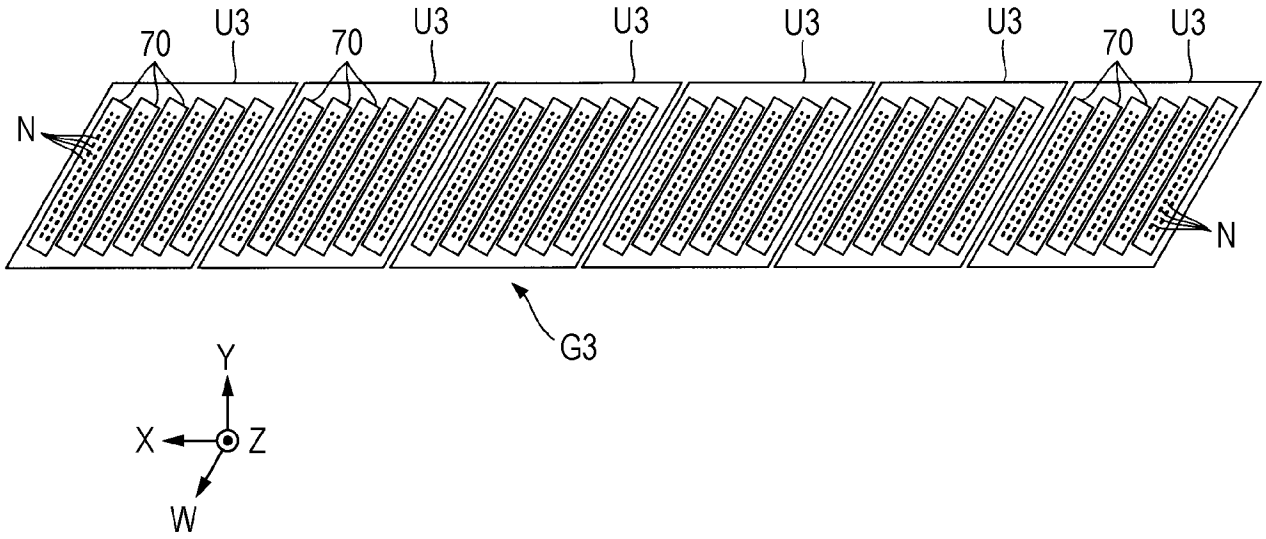
FIG. 4 is a plan view of the liquid ejecting head when viewed from the printing medium side.

FIG. 4 is a plan view of a surface of the liquid ejecting section G3 which faces the printing medium M. The six liquid ejecting units U3 are arranged along the X direction as illustrated in FIG. 4. Each liquid ejecting unit U3 includes a plurality of (six according to the first embodiment) ejection head units 70 along the X direction. Each ejection head unit 70 has a head chip that ejects the ink I from a plurality of nozzles N. The plurality of nozzles N of one ejection head unit 70 are arranged in two rows along a W direction which is inclined by a predetermined angle with respect to the X direction and the Y direction. Inks I of four systems (four colors) are supplied to each of the ejection head units 70 of the liquid ejecting units U3 in parallel. The plurality of nozzles N of one ejection head unit 70 are divided into four sets and each set ejects a different ink I.

Figure 5:
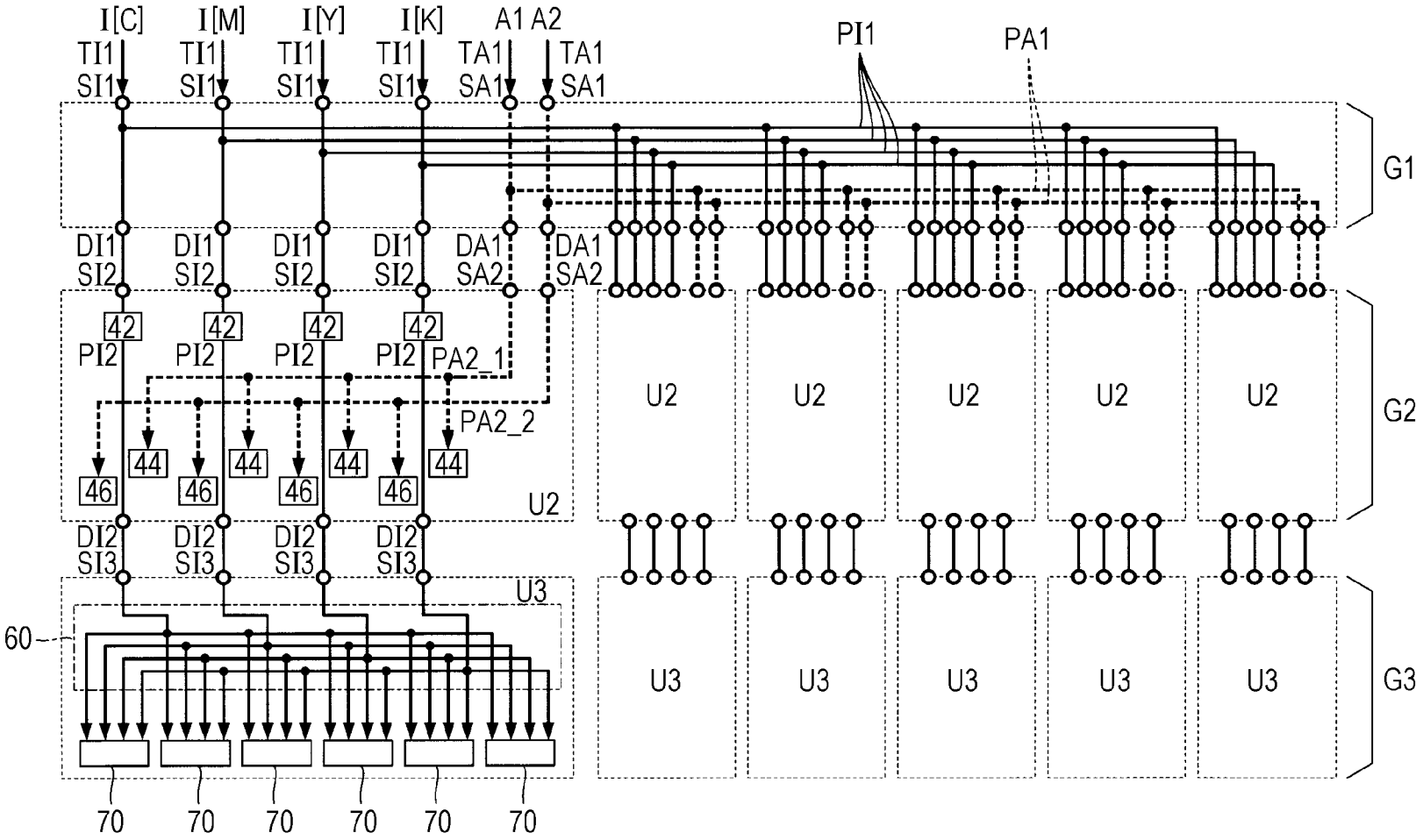
FIG. 5 is a diagram illustrating a flow path of the liquid ejecting head.

FIG. 5 is a diagram illustrating a configuration of the liquid ejecting head 14 when focusing on a flow path of a fluid (ink I and air A). As illustrated in FIG. 5, inks I of four systems are supplied from the liquid container 18 and air A (A1 and A2) of two systems are supplied from the pump 16 to the flow path structure G1. The flow path structure G1 distributes an ink I of each of the four systems and an air A of each of the two systems into six systems corresponding to the different liquid ejecting units U3. That is, the distribution number (6) of an ink I of one system exceeds the number K (K=4) of types of inks I in the flow path structure G1.

The flow path controlling section G2 in FIG. 2 and FIG. 3 is an element that controls the flow path of the liquid ejecting head 14 (for example, closing/opening of the flow path or pressure in the flow path), and is configured to have six flow path controlling units U2 corresponding to the different liquid ejecting unit U3. As illustrated in FIG. 5, inks I of four systems and the air A of two systems are distributed by the flow path structure G1 and thereby, are supplied to six flow path controlling units U2 in parallel. Each flow path controlling unit U2 controls opening or closing or pressure of the flow paths of the inks I of four systems which are distributed to each liquid ejecting units U3 by the flow path structure G1, in accordance with the air A of two systems.

Inks I of the four systems which passed each flow path controlling unit U2 after being distributed by the flow path structure G1 are supplied to the six liquid ejecting unit U3 in parallel. Each liquid ejecting unit U3 has the liquid distributing unit 60. The liquid distributing unit 60 distributes each of the inks I of the four systems supplied from the flow path controlling unit U2 of the previous stage into inks of six systems corresponding to a different ejection head unit 70. That is, the inks I of the four systems obtained after being distributed by the liquid distributing unit 60 are supplied to each of the six ejection head units 70 in parallel. Each ejection head unit 70 ejects each of the inks I of the four systems from a different nozzle N. As above, a specific example of each element (the flow path structure G1, the flow path controlling section G2, and the liquid ejecting section G3) of the liquid ejecting head 14 already described is described in detail hereinafter.

Flow Path Structure G1

Figure 6:
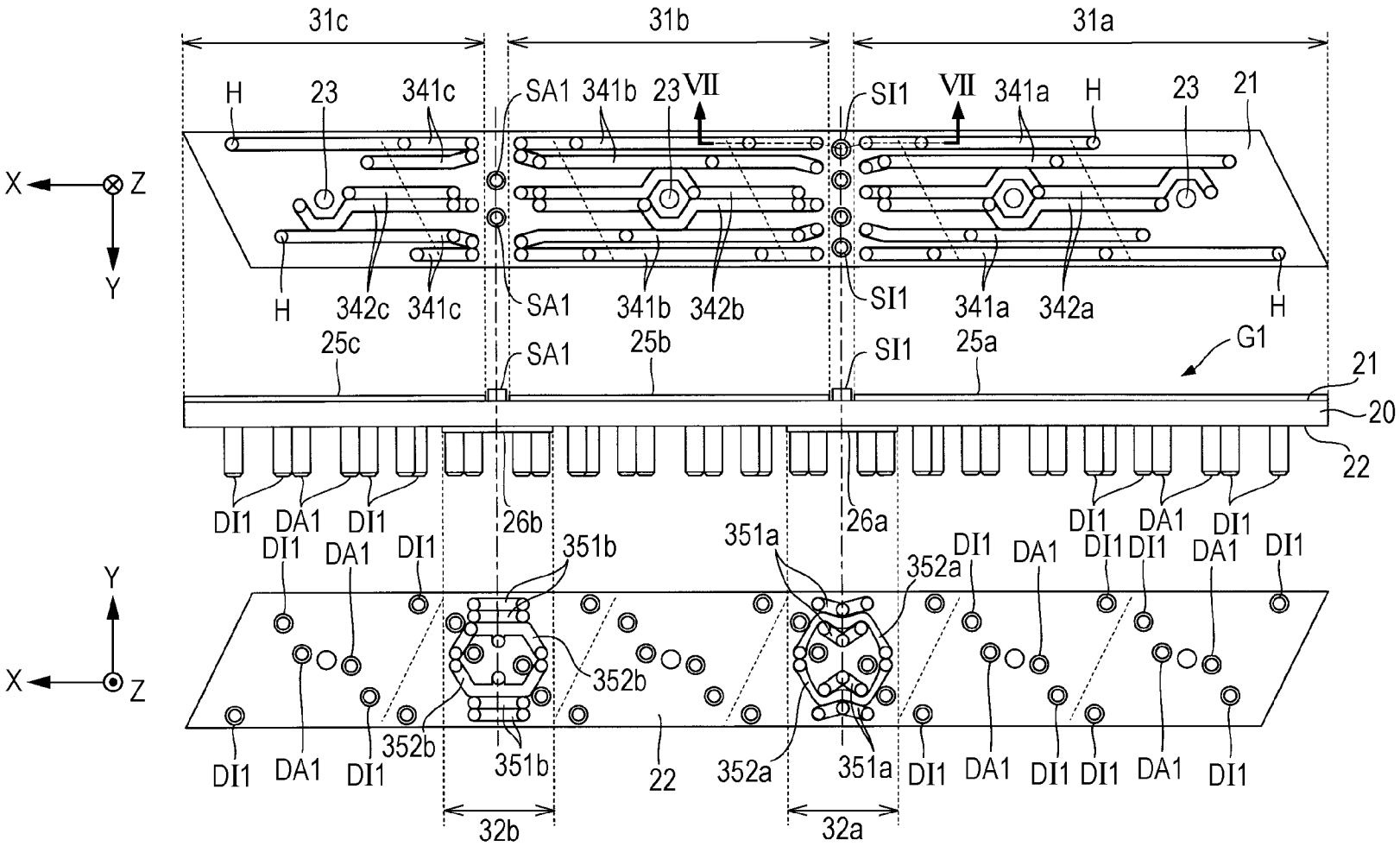
FIG. 6 illustrates side and plan views of a flow path structure.
Figure 7:
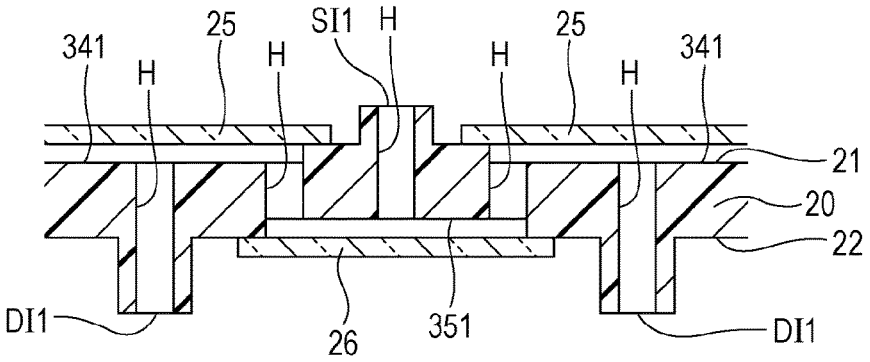
FIG. 7 is a cross-sectional view taken along line VII-VII in FIG. 6.

FIG. 6 illustrates side and plan views of the flow path structure G1 and FIG. 7 is a cross-sectional view taken line VII-VII in FIG. 6. As illustrated in a side view of FIG. 6, the flow path structure G1 according to the first embodiment is a flat plate-shaped structure which includes a substrate 20, a plurality of sealing portions 25 (25*a*, 25*b*, and 25*c*) and a plurality of sealing portions 26 (26*a* and 26*b*). In a plan view of FIG. 6, each sealing portion 25 and each sealing portion 26 are omitted from the drawing for convenience.

The substrate 20 according to the first embodiment is a flat plate material long in the X direction and has a first surface 21 and a second surface 22 parallel to the X-Y plane. In FIG. 6, a plan view of the first surface 21 and a plan view of the second surface 22 are illustrated together. The first surface 21 is a surface (top surface) on a side opposite to the flow path controlling section G2 or the liquid ejecting section G3 and the second surface 22 is a surface (surface facing the flow path controlling section G2) on a side opposite to the first surface 21. The substrate 20 according to the first embodiment is formed of a thermoplastic resin material (for example, polypropylene).

As illustrated in FIG. 6, the first surface 21 of the substrate 20 has a region 31*a*, a region 31*b*, and a region 31*c*. Four supply ports SI1 corresponding to inks I of systems, respectively, are formed between the region 31*a* and region 31*b* of the first surface 21. Two supply ports SA1 corresponding to air A of systems, respectively, are formed between the region 31*b* and region 31*c* of the first surface 21.

Figure 8:
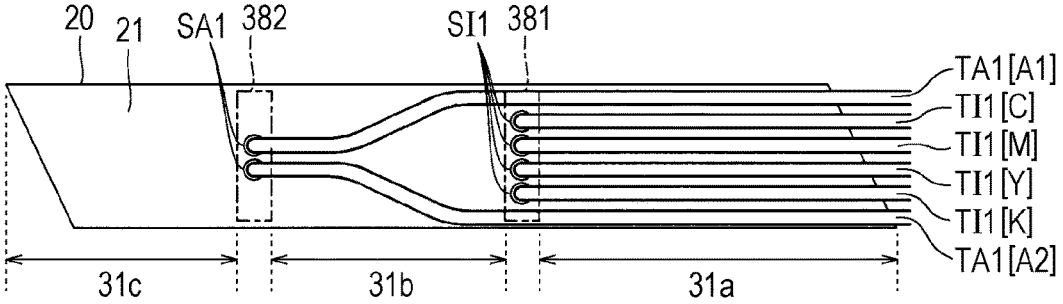
FIG. 8 is a view illustrating a relationship between the flow path structure and supply tubes of ink and air.

FIG. 8 is a view illustrating a joining state of the flow path structure G1. As illustrated in FIG. 8, an end of a supply tube TI1 of each ink I is joined to each of the four supply ports SI1 via a joint 381 disposed on the first surface 21. Each of the supply tubes TI1 extends on the surface of the region 31*a* in the X direction and an end on a side opposite to the supply port SI1 is joined to the liquid container 18. An end of the supply tube TA1 of each air A (A1 and A2) is joined to each of the two supply ports SA1 via the joint 382 disposed on the first surface 21. Each supply tube TA1 extends on the surface of the region 31*b* and region 31*a* in the X direction and an end thereof on a side opposite to the supply port SA1 is joined to the pump 16. In the above configuration, the inks I (C, M, Y, and K) of the four systems stored in the liquid container 18 are supplied to the four supply ports SI1 in parallel via each of the supply tubes TI1 and the air A (A1 and A2) of the two systems transmitted from the pump 16 are supplied to the two supply ports SA1 in parallel via each of the supply tubes TA1.

As illustrated in FIG. 6, four grooves 341*a* corresponding to the inks I, respectively, are formed on the region 31*a* of the first surface 21 of the substrate 20. Similarly, four grooves 341*b* are formed on the region 31*b* and four grooves 341*c* are formed on the region 31*c*. The grooves 341*a* and the grooves 341*b* are positioned on the opposite sides to each other interposing the supply ports SI1 therebetween in a plan view (that is, when viewed from the Z direction perpendicular to the substrate 20). In addition, two grooves 342*a* corresponding to flows of air A are formed on the region 31*a* of the first surface 21 of the substrate 20. Similarly, two grooves 342*b* are formed on the region 31*b* and two grooves 342*c* are formed on the region 31*c*. The grooves 342*b* and the grooves 342*c* are positioned on the opposite sides to each other interposing the supply ports SA1 therebetween in a plan view. As illustrated in FIG. 6, in the regions 31 (31*a*, 31*b*, and 31*c*) of the first surface 21, the grooves 341 (341*a*, 341*b*, and 341*c*) corresponding to inks I are positioned on both sides interposing the two grooves 342 (342*a*, 342*b*, and 342*c*) corresponding to flows of air A therebetween.

Schematically, the grooves 341 (341*a*, 341*b*, and 341*c*) and the grooves 342 (342*a*, 342*b*, and 342*c*) are grooves (front-side grooves) formed so as to extend in the X direction. Specifically, according to the first embodiment, the grooves 341 corresponding to inks I extend along the X direction substantially linearly and the grooves 342 corresponding to the flows of air A is formed in a bent shape so as to bypass an attachment hole 23 formed on the substrate 20. The attachment holes 23 are through-holes used to fix the substrate 20 and, specifically, are screw holes into which screws (not illustrated) that fix the flow path structure G1 to the flow path controlling section G2 are inserted.

As illustrated in the side view of FIG. 6, the separate sealing portions 25 (25*a*, 25*b*, and 25*c*) are disposed in the regions 31 (31*a*, 31*b*, and 31*c*) of the first surface 21, respectively. Specifically, the sealing portion 25*a* is disposed in the region 31*a*, the sealing portion 25*b* is disposed in the region 31*b*, and the sealing portion 25*c* is disposed in the region 31*c*. The sealing portions 25 are film-like (film thickness of about 0.1 mm) members which adhere to the first surface 21 of the substrate 20 and seal (close) the grooves 341 and the grooves 342 formed on the first surface 21, thereby configuring the flow paths.

As illustrated in FIG. 6, the second surface 22 of the substrate 20 has a region 32*a* and a region 32*b*. The region 32*a* is a region which is overlapped with a region (that is, a region on which the four supply ports SI1 are formed) of a space between the region 31*a* and the region 31*b* of the first surface 21 in a plan view. The region 32*b* is a region which is overlapped with a region (that is, a region on which the two supply ports SA1 are formed) of a space between the region 31*b* and the region 31*c* of the first surface 21 in a plan view.

Four grooves 351*a* corresponding to the inks I, respectively, and two grooves 352*a* corresponding to the flows of air A, respectively, are formed in the region 32*a* of the second surface 22. Similarly, four grooves 351*b* and two grooves 352*b* are formed in the region 32*b*. The grooves 351 (351*a* and 351*b*) and the grooves 352 (352*a* and 352*b*) are grooves (rear-side grooves) formed on the second surface 22. The four grooves 351*b* are positioned on the outer side of the two grooves 352*b* in the region 32*b* and the groove 352*a* is positioned in a space between a pair of the grooves 351*a* in the region 32*a*.

In FIG. 6, the boundary of each of the liquid ejecting units U3 is illustrated in a dashed line. As illustrated in FIG. 6, four discharge ports DI1 corresponding to inks I, respectively, and two discharge ports DA1 corresponding to the flows of air A, respectively, are formed in each of the six liquid ejecting units U3 (each of the six flow path control units U2) on the second surface 22. The discharge ports DI1 and the discharge ports DA1 are circular tube-shaped portions which protrude from the second surface 22 in the Z direction.

The six discharge ports DI1 corresponding to the inks I of any one system are arranged substantially at equal intervals along the X direction so as to be overlapped with the grooves 341 (341*a*, 341*b*, and 341*c*) corresponding to the inks I on the first surface 21 in a plan view. As illustrated in FIG. 7, the six discharge ports DI1 communicate with the grooves 341, respectively, via a through-hole H that penetrates the substrate 20 in the Z direction. Similarly, the six discharge ports DA1 corresponding to air A of any one system are arranged substantially at equal intervals along the X direction so as to be overlapped with the grooves 342 (342*a*, 342*b*, and 342*c*) corresponding to the air A on the first surface 21 in a plan view. The six discharge ports DA1 communicate with the grooves 342, respectively, via the through-hole H that penetrates the substrate 20.

As illustrated in the side view of FIG. 6, the separate sealing portions 26 (26*a* and 26*b*) are disposed in the regions 32 (32*a* and 32*b*) of the second surface 22, respectively. Specifically, the sealing portion 26*a* is disposed in the region 32*a*, and the sealing portion 26*b* is disposed in the region 32*b*. The sealing portions 26 are film-like (film thickness of about 0.1 mm) members which adheres to the second surface 22 and, similar to the sealing portions 25 on the first surface 21 side, seal the grooves 351 (351*a* and 351*b*) and the grooves 352 (352*a* and 352*b*) formed on the second surface 22, thereby configuring the flow paths. As described above, according to the first embodiment, since the film-like sealing portions 25 and sealing portions 26 are disposed on the substrate 20, there is an advantage in that it is possible to decrease a size (thickness) of the flow path structure G1 in the Z direction, for example, compared to a configuration in which the flow paths are formed by causing a flat plate material with a predetermined thickness to adhere to the substrate 20. In addition, according to the first embodiment, since the plurality of sealing portions 25 are disposed on the first surface 21, there is an advantage in that it is easy to dispose the sealing portions 25 (it is possible to reduce failure of sealing of the grooves) compared to a configuration in which a single sealing portion 25 covers the entire first surface 21. The same is true of the sealing portions 26.

The sealing portions 25 and the sealing portions 26 according to the first embodiment have a surface layer formed of the same material (thermoplastic resin material such as polypropylene) as that of the substrate 20 and the surface of the surface layer is pressed against the substrate 20 in a heated state and thereby is welded to the substrate 20. Thus, there is an advantage in that it is easy to dispose the sealing portions 25 and the sealing portions 26. For example, the sealing portions 25 and the sealing portions 26 are appropriately configured by laminating PET and polypropylene. In addition, according to the first embodiment, the sealing portions 25 and the sealing portions 26 are formed separately from each other. Thus, there is an advantage in that it is easy to dispose the sealing portions 25 and the sealing portions 26, compared to a configuration in which the sealing portions 25 and the sealing portions 26 are formed integrally to each other.

As illustrated in FIG. 6 and FIG. 7, the grooves 351*a* on the second surface 22 communicate with the supply ports SI1 on the first surface 21 via the through-hole H of the substrate 20. In addition, the grooves 351 (351*a* and 351*b*) on the second surface 22 communicate with the grooves 341 on the first surface 21 via the through-hole H of the substrate 20. Specifically, as understood from FIG. 6, the grooves 351*a* communicate with the grooves 341*a* and grooves 341*b*, and the grooves 351*b* communicate with the grooves 341*b* and the grooves 341*c*. That is, the grooves 341*a* and grooves 341*b* and the grooves 341*c* on the first surface 21 communicate with each other via the grooves 351*a* and the grooves 351*b* on the second surface 22. As understood from the above description, a flow path PI1 in FIG. 5 which reaches the six discharge ports DI1 on the second surface 22 from any one supply port SI1 through the grooves 351 on the second surface 22 and the grooves 341 on the first surface 21 is formed for each of the of inks of four systems. That is, the flow path PI1 distributes the ink I of one system supplied to the supply port SI1 into six discharge ports DI1.

The grooves 352*b* on the second surface 22 in FIG. 6 communicate with the supply ports SA1 on the first surface 21 via the through-hole H of the substrate 20. In addition, the grooves 352 (352*a* and 352*b*) on the second surface 22 communicate with the grooves 342 on the first surface 21 via the through-hole H of the substrate 20. Specifically, the grooves 352*a* communicate with the grooves 342*a* and grooves 342*b*, and the grooves 352*b* communicate with the grooves 342*b* and the grooves 342*c*. That is, the grooves 342*a* and grooves 342*b* and the grooves 342*c* on the first surface 21 communicate with each other via the grooves 352*a* and the grooves 352*b* on the second surface 22. As understood from the above description, a flow path PA1 in FIG. 5 which reaches the six discharge ports DA1 on the second surface 22 from any one supply port SA1 through the grooves 352 on the second surface 22 and the grooves 342 on the first surface 21 is formed for each of the air A of the two systems. That is, the flow path PA1 distributes the air A (A1 and A2) of one system supplied to the supply port SA1 into six discharge ports DA1. The flow path PA1 according to the first embodiment is bent in the X-Y plane so as to bypass the attachment hole 23. Although there is a problem in that resistance in the flow path is increased in a case where the flow path PI1 for supplying the ink I is bent similarly, the increase of the resistance in the flow path due to bending of the flow path PA1 does not cause a particular problem because the fluid which circulates the flow path PA1 is the air A.

As above, in the flow path structure G1 according to the first embodiment, the flow paths (PI1 and PA1) which reach the plurality of discharge ports (DI1 and DA1) from the supply ports (SI1 and SA1) are formed for each of the plurality of fluids including the ink I and the air A. As understood from FIG. 6, according to the first embodiment, two sets of four flow paths PI1 for distributing the ink I are positioned on both sides of the two flow paths PA1 for distributing the air A. The flow path structure G1 according to the first embodiment is configured as above.

As described above, according to the first embodiment, since the supply ports (SI1 and SA1) are formed on the first surface 21 of the substrate 20 and the discharge ports (DI1 and DA1) are formed on the second surface 22 of the substrate 20, the flow path structure G1 is decreased in size when viewed from the Z direction, compared to the configurations according to JP-A-2004-330717 and JP-T-2005-500926 in which the supply port and the discharge port are formed on the side surfaces of the substrate so as to join tubes to each other. Thus, it is possible to decrease the liquid ejecting head 14 in size.

Flow Path Controlling Section G2

As illustrated in FIG. 2, four supply ports SI2 and two supply ports SA2 are formed on a surface, which faces the flow path structure G1, of each of the flow path controlling units U2 of the flow path controlling section G2. In a state in which the flow path structure G1 and the flow path controlling units U2 are fixed to each other, the discharge port DI1 of the flow path structure G1 is inserted into the supply port SI2 of the flow path controlling unit U2 and the discharge port DA1 of the flow path structure G1 is inserted into the supply port SA2 of the flow path controlling unit U2. Thus, as understood also from FIG. 5, the inks I of each system is supplied to each of the supply ports SI2 of the flow path controlling unit U2 from each of the discharge ports DI1 of the flow path structure G1 and the air A of each system is supplied to each of the supply ports SA2 of the flow path controlling unit U2 from each of the discharge ports DA1 of the flow path structure G1. As illustrated above, according to the first embodiment, since the discharge port DI1 of the flow path structure G1 and the supply port SI2 of each of the flow path controlling units U2 are directly joined to each other, it is possible to realize reduction of the number of components, prevention of liquid leakage, or the like, compared to a configuration in which the discharge port DI1 and the supply port SI2 are joined using a tube.

As illustrated in FIG. 3, four discharge ports DI2 are formed on a surface of each of the flow path controlling units U2 which is opposite to liquid ejecting section G3. As illustrated in FIG. 5, the flow path controlling unit U2 includes four systems of flow path PI2 which reach each of the discharge ports DI2 from each of the supply ports SI2. Each of the inks I of the four systems supplied to each of the flow path controlling unit U2 after being distributed by the flow path structure G1 is supplied to the liquid ejecting unit U3 on the next stage in parallel from the four discharge ports DI2 through each of the flow paths PI2.

As illustrated in FIG. 5, in the flow path controlling unit U2, a negative pressure generating unit 42, a flow path opening/closing unit 44 and a pressure adjusting unit 46 are disposed in each of the four systems of the flow paths PI2. In addition, the flow path controlling unit U2 according to the first embodiment includes a flow path PA2_1 through which the air A1 supplied to the supply port SA2 is distributed into four systems corresponding to the flow paths PI2 and a flow path PA2_2 through which the air A2 supplied to the supply port SA2 is distributed into four systems corresponding to the flow paths PI2. The air A1 distributed by the flow path PA2_1 is supplied to the four flow path opening/closing units 44 of the flow path controlling unit U2 in parallel and the air A2 distributed by the flow path PA2_2 is supplied to the four pressure adjusting units 46 of the flow path controlling unit U2 in parallel.

Figure 9:
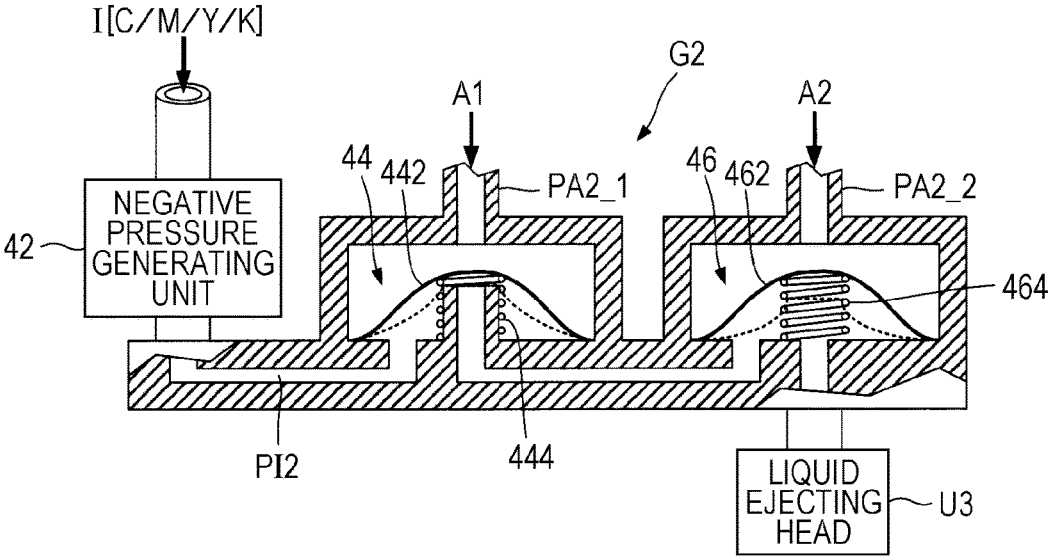
FIG. 9 is a configurational view focusing on a flow path of an ink of one system of a flow path controlling section.

FIG. 9 is a configurational view focusing on the flow path PI2 of the ink I of any one system of the flow path controlling unit U2. As illustrated in FIG. 9, the negative pressure generating unit 42 is disposed on the flow path PI2 and maintains predetermined negative pressure in the flow path PI2. Specifically, a pressure control valve that closes the flow path PI2 in a normal state, opens the flow path PI2 autonomously in a case where the negative pressure in the flow path PI2 reaches a predetermined value due to ejection (consuming) of the ink I by the liquid ejecting unit U3, and causes the ink I to flow in may appropriately be employed as the negative pressure generating unit 42. As illustrated in FIG. 9, the flow path opening/closing unit 44 is disposed on the downstream side of the negative pressure generating unit 42 in the flow path PI2 and the pressure adjusting unit 46 is disposed on the downstream side of the flow path opening/closing unit 44 in the flow path PI2. That is, the flow path opening/closing unit 44 is positioned between the negative pressure generating unit 42 and the pressure adjusting unit 46 on the flow path PI2.

The flow path opening/closing unit 44 is a mechanism (choke valve) which controls opening and closing of the flow path PI2 according to the air A1 supplied through the flow path PA2_1. The flow path opening/closing unit 44 illustrated in FIG. 9 is configured to have a flexible member 442 which is interposed between the flow path PI2 of the ink I and the flow path PA2_1 of the air A1 and an elastic body 444 which biases the flexible member 442 to the side of the flow path PA2_1. The flow path PI2 is opened in a normal state (decompression state) in which the air A1 of the flow path PA2_1 is not pressurized and, when the air A1 is pressurized by the pump 16, the flow path PI2 is closed by the deformation of the flexible member 442 against the bias by the elastic body 444, as illustrated in a dashed line of FIG. 9.

The pressure adjusting unit 46 in FIG. 9 is a mechanism which adjusts the pressure (volume of the flow path PI2) in the flow path PI2 and, for example, a negative pressure relief valve that releases the negative pressure of the flow path PI2. Specifically, the pressure adjusting unit 46 in FIG. 9 is configured to have a flexible member 462 which is interposed between the flow path PI2 of the ink I and the flow path PA2_2 of the air A2 and an elastic body 464 which biases the flexible member 462 to the side of the flow path PA2_2. The air A2 in the flow path PA2_2 is set to atmospheric pressure (opening to the atmosphere) in a normal state and, when the air A2 is pressurized by the pump 16, the pressure of the flow path PI2 is increased to the extent that the negative pressure is released by the negative pressure generating unit 42 by the deformation of the flexible member 462 to the side of the flow path PI2 against the bias by the elastic body 464 (the volume of the flow path PI2 is decreased), as illustrated in a dashed line of FIG. 9.

For example, during cleaning the liquid ejecting unit U3 (ejection head unit 70), the negative pressure of the flow path of the ink I is released and then, the ink I is ejected from each of the nozzles N. Here, in a state in which the negative pressure generating unit 42 is valid, the relief of the negative pressure by the pressure adjusting unit 46 can be failed. Thus, there is a possibility that the ink I is not sufficiently discharged from each of the nozzles N or that bubbles enters the flow path from each of the nozzles N. According to the first embodiment, since the air A1 in the flow path PA2_1 is pressurized and thereby, the flow path PI2 is closed by the flow path opening/closing unit 44, the air A2 in the flow path PA2_2 is pressurized and thereby, the negative pressure of the flow path PI2 is released by the pressure adjusting unit 46. According to the above operation, since the release of the negative pressure is performed by the pressure adjusting unit 46 in a state (that is, state in which application of the negative pressure by the negative pressure generating unit 42 is invalid) in which the flow path PI2 is closed by the flow path opening/closing unit 44 such that the negative pressure generating unit 42 and the pressure adjusting unit 46 are isolated from each other, there is an advantage in that it is possible to effectively release the negative pressure of the flow path on the downstream side of the flow path opening/closing unit 44.

As understood from the above description, the negative pressure generating unit 42, the flow path opening/closing unit 44, and the pressure adjusting unit 46 according to the first embodiment function as elements that control the flow path PI2 of each of the inks I and the flow path controlling section G2 is collectively described as an element that controls each of the flow path PI2 using the each of the air A (A1 and A2) of the systems obtained after being distributed by the flow path structure G1. A configuration of each of the flow path controlling unit U2 of the flow path controlling section G2 according to the first embodiment is as above.

Flow Path Structure G3

The liquid ejecting section G3 ejects, from the nozzles N, the inks I of each system which passed through the flow path controlling section G2. As illustrated in FIG. 2, four supply ports SI3 are formed on a surface, which faces the flow path controlling section G2, of each of the liquid ejecting units U3 of the liquid ejecting section G3. In a state in which flow path controlling section G2 and the liquid ejecting section G3 (casing 142) are fixed to each other, the supply port SI3 of each of the liquid ejecting units U3 is inserted into each of the discharge ports DI2 of the flow path controlling unit U2. Thus, as understood also from FIG. 5, the inks I of each system are supplied to the four supply ports SI3 of each of the liquid ejecting unit U3 from the discharge ports DI2 of the flow path controlling unit U2.

Figure 10:
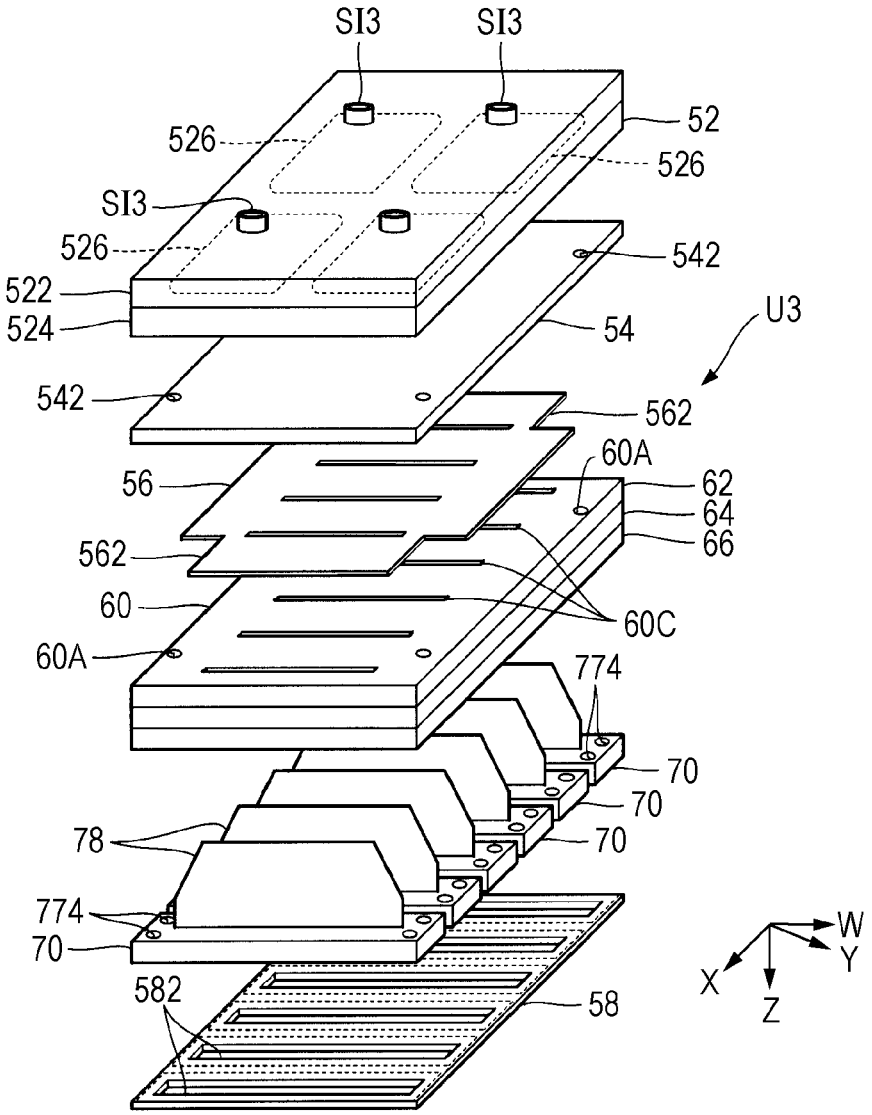
FIG. 10 is an exploded perspective view of a liquid ejecting unit.

FIG. 10 is an exploded perspective view of any one liquid ejecting unit U3. As illustrated in FIG. 10, the liquid ejecting unit U3 has a filter section 52, a communication member 54, a wiring substrate 56, a liquid distributing unit 60, six ejection head units 70, and a fixing plate 58. The liquid distributing unit 60 is disposed between the six ejection head units 70 and the filter section 52 and the communication member 54 and the wiring substrate 56 are disposed between the liquid distributing unit 60 and the filter section 52. As understood from the above description, the flow path controlling section G2 (the flow path controlling unit U2), the filter section 52, the communication member 54, and the wiring substrate 56 are disposed between the flow path structure G1 and the liquid distributing unit 60 which are overlapped with each other in a plan view. In addition, the casing 142 that accommodates and supports the six liquid ejecting units U3 is also positioned between the flow path structure G1 and the liquid distributing unit 60.

The filter section 52 is an element that removes bubbles or foreign substances contained in each of the inks I supplied from the flow path controlling section G2 and is configured to include a first member 522 and a second member 524 which are fixed in a state of facing each other and four filters 526 corresponding to the inks I as illustrated in FIG. 10. The first member 522 and the second member 524 are flat plates formed of a resin material such as Zylon (registered trademark). The four supply ports SI3, to which each of the inks I that passed the flow path controlling section G2 is supplied, are formed on a surface of the first member 522 which is on a side opposite to the second member 524.

Figure 11:
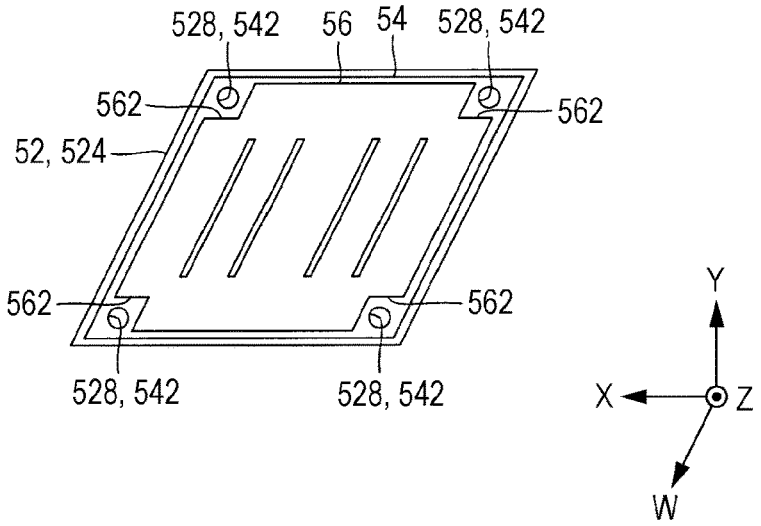
FIG. 11 is a plan view of a filter section, a communication member, and a wiring substrate when viewed from the printing medium side.

FIG. 11 is a plan view of a stack of the filter section 52, the communication member 54, and the wiring substrate 56 when viewed from the side of the ejection head unit 70. In FIG. 11, illustration of the liquid distributing unit 60 and the ejection head unit 70 are appropriately omitted. As illustrated in FIG. 11, four discharge ports 528 corresponding to the inks I are formed in the vicinity of circumferential edges (four corners) of the second member 524 of the filter section 52. The four filters 526 are disposed between the first member 522 and the second member 524 such that the ink I of one system supplied to any one supply port SI3 passes through the filter 526 and then, reaches one discharge port 528. The filter section 52 according to the first embodiment is configured to be a separate member from the liquid distributing unit 60 and fixed to the liquid distributing unit 60 by a fixing unit (not illustrated) such as a screw. It is possible to detach the filter section 52 from the liquid distributing unit 60 by releasing the fixing state. That is, the filter section 52 and the liquid distributing unit 60 are fixed to each other detachably.

The communication member 54 in FIG. 10 enables each of the discharge ports 528 of the filter section 52 to communicate with the liquid distributing unit 60. The communication member 54 according to the first embodiment is a flat plate formed of an elastic material (for example, rubber). As illustrated in FIG. 11, a plurality of through-holes 542 corresponding to the discharge ports 528 of the filter section 52 are formed in the communication member 54. Specifically, each of the through-hole 542 is positioned each corner portions (four corners) of the communication member 54 in a plan view.

The wiring substrate 56 in FIG. 10 is a substrate on which a wiring for transmitting a drive signal or a supply voltage to each of the ejection head units 70 is formed. It is possible to mount an electronic circuit that generates the drive signal or the supply voltage on the wiring substrate 56. A notch 562 is formed at a position of the wiring substrate 56 according to the first embodiment which corresponds to each of the discharge ports 528 (each of the through-holes 542 of the communication member 54) of the filter section 52. Thus, as understood from FIG. 11, in a state in which the wiring substrate 56 is disposed on a side opposite to the filter section 52 interposing the communication member 54 therebetween, the wiring substrate 56 does not overlap with the through-holes 542 (discharge ports 528) in a plan view.

The liquid distributing unit 60 in FIG. 10 distributes each of the inks I of four systems (inks I of four systems which passes through the flow path controlling section G2 after being distributed by the flow path structure G1) supplied via each of the through-holes 542 of the communication member 54 into six systems corresponding to the ejection head units 70. That is, the distribution number (6) of the ink I of one system by the liquid distributing unit 60 exceeds the number K (K=4) of the kinds of the ink I. According to the first embodiment, since the liquid distributing unit 60 is disposed on the side of each of the ejection head unit 70 when viewed from the wiring substrate 56, the total number of flow paths passing through a flat surface including the wiring substrate 56 is decreased, compared to a configuration in which the wiring substrate 56 is disposed between the liquid distributing unit 60 and each of the ejection head unit 70. Thus, there is an advantage in that it is possible to sufficiently secure a flexibility of a shape of the flat surface of the wiring substrate 56.

As illustrated in FIG. 10, the liquid distributing unit 60 according to the first embodiment is a flat plate-shaped structure in which a first flow path substrate 62, a second flow path substrate 64, and a third flow path substrate 66 are stacked in the order above from the side of the wiring substrate 56 to the side of each of the ejection head units 70. The first flow path substrate 62, the second flow path substrate 64, and the third flow path substrate 66 are molded of a resin material such as Zylon and are fixed to each other using an adhesive. As understood from the above description, rigidity (mechanical strength against an external force) of the liquid distributing unit 60 is greater than rigidity of the flow path structure G1.

Figure 12:
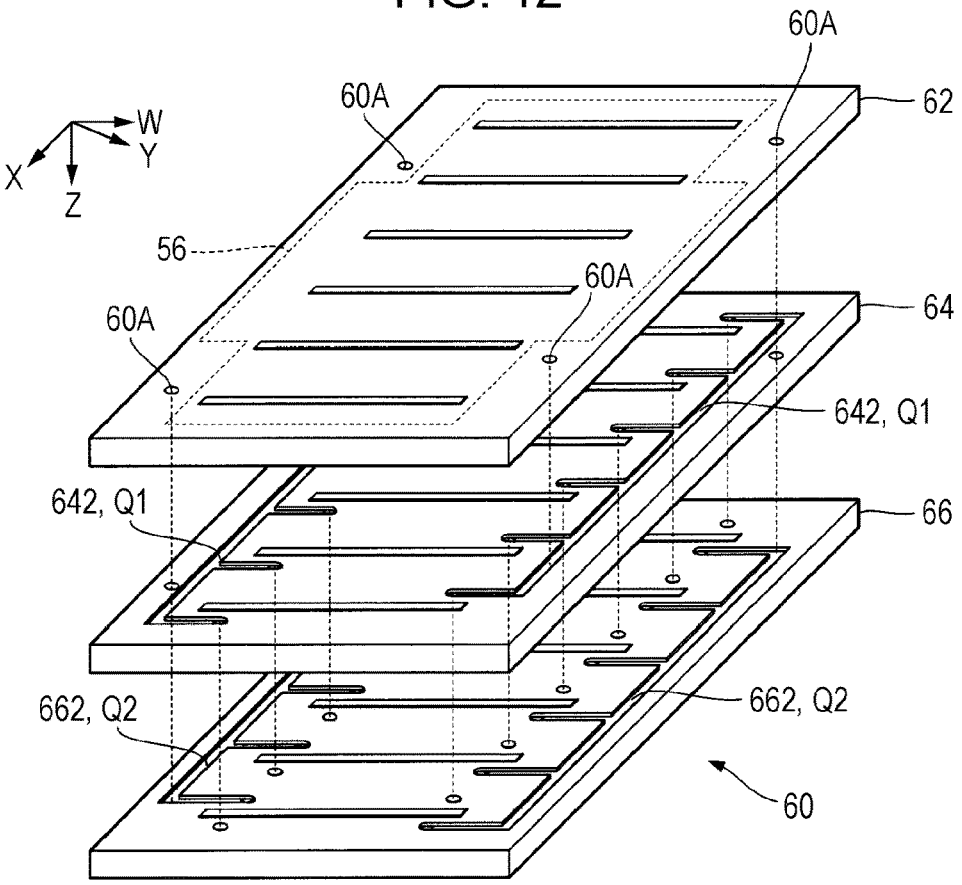
FIG. 12 is an exploded perspective view of a liquid distributing unit.

FIG. 12 is an exploded perspective view of the liquid distributing unit 60. An outline of the wiring substrate 56 which is stacked on the first flow path substrate 62 is illustrated in FIG. 12 in a dashed line for convenience. As illustrated in FIG. 12, supply ports 60A corresponding to the inks I are formed at four places (four corners) of the first flow path substrate 62 which corresponds to notches 562 of the wiring substrate 56. The communication member 54 is pressed to the side of the wiring substrate 56 in a state in which the wiring substrate 56 is interposed between the communication member 54 and the liquid distributing unit 60. In this way, the first flow path substrate 62 and the communication member 54 comes into close contact with each other inside each of the notches 562 of the wiring substrate 56 and, as a result, each of the through-holes 542 of the communication member 54 (each of the discharge port 528 of the filter section 52) and each of the supply ports 60A of the liquid distributing unit 60 communicate with each other. That is, each of the inks I of the four systems which passed through the filter section 52 and the communication member 54 is supplied to each of the supply ports 60A of the liquid distributing unit 60 in parallel. Since the liquid distributing unit 60 according to the first embodiment is formed of a material with a higher rigidity compared to the flow path structure G1, it is possible to effectively prevent the liquid distributing unit 60 from deformation or damage due to a pressing force from the communication member 54, for example, compared to a configuration in which the liquid distributing unit 60 is formed of the same material as that of the flow path structure G1.

Figure 13:
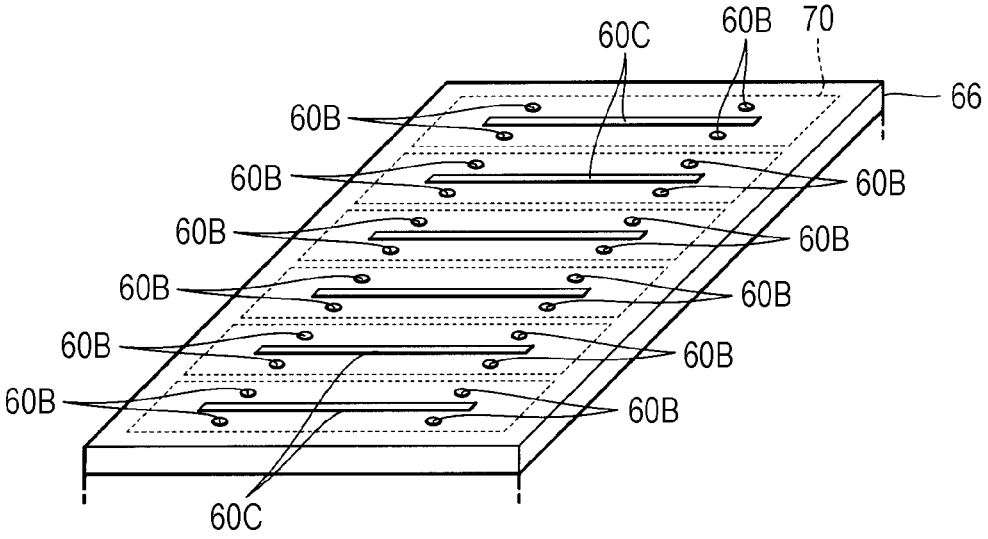
FIG. 13 is a perspective view of a liquid distributing unit when viewed from the printing medium side.

FIG. 13 is a perspective view of the third flow path substrate 66 of the liquid distributing unit 60 when viewed from the side of the ejection head unit 70. An outline of each of the ejection head units 70 is illustrated in FIG. 13 in a dashed line for convenience. As illustrated in FIG. 13, four discharge ports 60B corresponding to the inks I of the four systems are formed on the third flow path substrate 66 for each of the six ejection head units 70 (that is, a total of 36).

Figure 14:
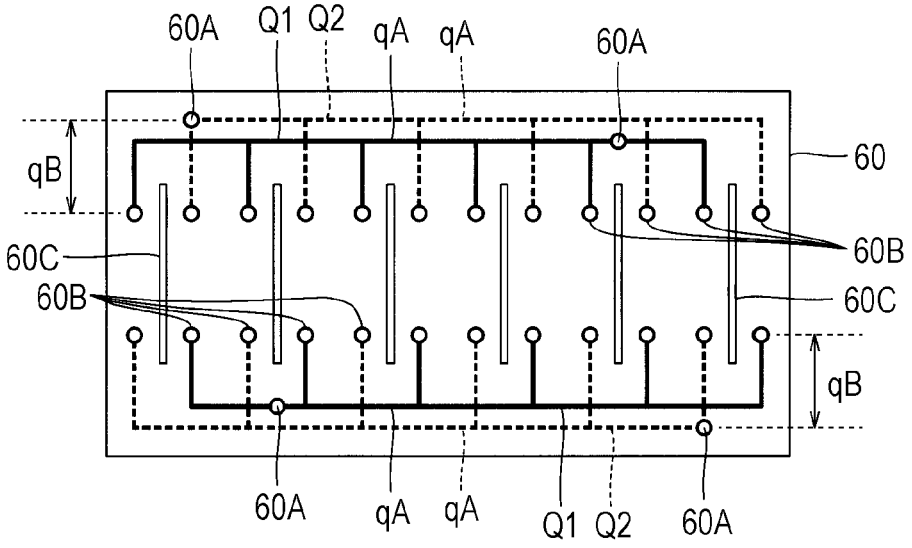
FIG. 14 is a view illustrating a flow path formed inside the liquid distributing unit.

FIG. 14 is a view illustrating a flow path formed inside the liquid distributing unit 60. As illustrated in FIG. 14, four flow paths Q (Q1 and Q2) are formed inside the liquid distributing unit 60 according to the first embodiment. The four flow paths Q include the two flow paths Q1 and the two flow paths Q2. A set of one flow path Q1 and one flow path Q2 is formed in the vicinity of a circumferential edge of the liquid distributing unit 60 which is positioned at each of the positive side and the negative side of the Y direction in a plan view. Each flow path Q distributes the ink I supplied to one supply port 60A to six discharge ports 60B corresponding to the different ejection head units 70. Specifically, each flow path Q is configured to have one main base qA extending in the X direction and six branches qB which are branches in the W direction from different positions of the main base qA in the X direction. The supply port 60A communicates with the main base qA of each flow path Q and the discharge port 60B communicates with an end of each of the six branches qB of each flow path Q.

As illustrated in FIG. 12, a groove 642 corresponding to each flow path Q1 is formed on a surface of the second flow path substrate 64 which faces the first flow path substrate 62. The groove 642 on the surface of the second flow path substrate 64 is closed by the surface of the first flow path substrate 62 (surface facing the second flow path substrate 64) and thereby, the flow path Q1 is formed. As understood from FIG. 12, the main base qA of the flow path Q1 (groove 642) communicates with the supply port 60A via a through-hole formed on the first flow path substrate 62 and each of the branches qB of the flow path Q1 communicates with the discharge port 60B via a through-hole formed on the second flow path substrate 64 and the third flow path substrate 66. In the illustration of FIG. 12, the flow path Q1 is formed of the groove 642 on the surface of the second flow path substrate 64; however, it is possible to employ a configuration in which the flow path Q1 is formed of a groove formed on a surface of the first flow path substrate 62 which faces the second flow path substrate 64 or a configuration in which the flow path Q1 (particularly the main base qA) is formed by joining the grooves formed on the surfaces of the first flow path substrate 62 and the second flow path substrate 64 which face each other.

As illustrated in FIG. 12, a groove 662 corresponding to each flow path Q2 is formed on a surface of the third flow path substrate 66 which faces the second flow path substrate 64. The groove 662 on the surface of the third flow path substrate 66 is closed by the surface of the second flow path substrate 64 (surface joined to the third flow path substrate 66) and thereby, the flow path Q2 is formed. As understood from FIG. 12, the main base qA of the flow path Q2 (groove 662) communicates with the supply port 60A via through-holes formed on the first flow path substrate 62 and the second flow path substrate 64 and each of the branches qB of the flow path Q2 communicates with the discharge port 60B via the through-hole formed on the third flow path substrate 66. In the illustration of FIG. 12, the flow path Q2 is formed of the groove 662 on the surface of the third flow path substrate 66; however, it is possible to employ a configuration in which the flow path Q2 is formed of a groove formed on a surface of the second flow path substrate 64 which faces the third flow path substrate 66 or a configuration in which the flow path Q2 (particularly the main base qA) is formed by joining the grooves formed on the surfaces of the second flow path substrate 64 and the third flow path substrate 66 which face each other.

As described above, each flow path Q1 is formed between the first flow path substrate 62 and the second flow path substrate 64 and each flow path Q2 is formed between the second flow path substrate 64 and the third flow path substrate 66. That is, the positions of the flow path Q1 and the flow path Q2 are different from each other in the Z direction. As a result of employing the above configuration, as understood from FIG. 12 and FIG. 14, the flow path Q1 and the flow path Q2 are partially overlapped with each other in a plan view. Thus, there is an advantage in that the liquid distributing unit 60 is decreased in size (furthermore, a size of the liquid ejecting head 14) when viewed from the Z direction, for example, compared to a configuration in which both the flow path Q1 and the flow path Q2 are formed between a pair of substrates. The specific example of the structure of the liquid distributing unit 60 according to the first embodiment is as above.

Figure 15:
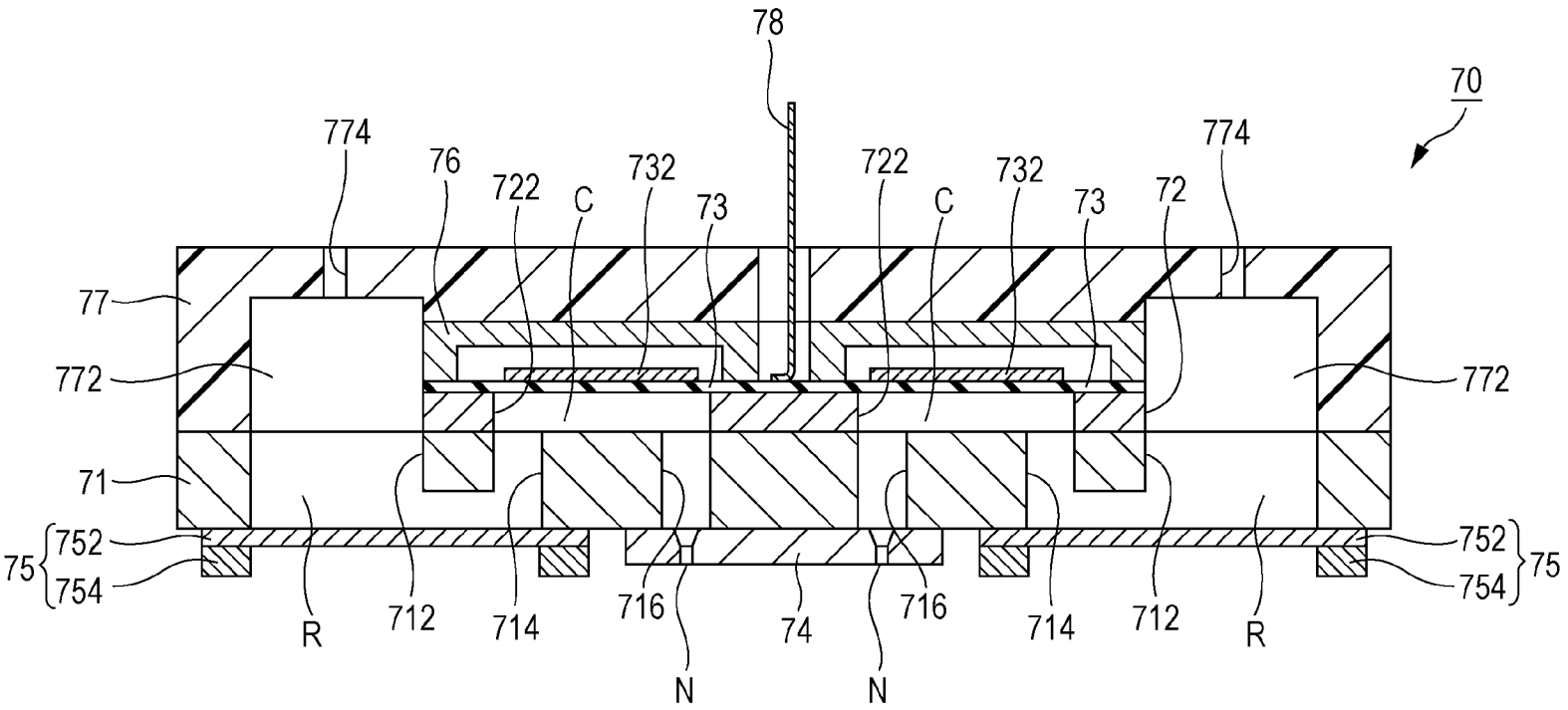
FIG. 15 is a cross-sectional view of an ejection head unit.

Each of the six ejection head units 70 in FIG. 10 ejects, from each of the nozzles N, the inks I of four systems supplied from each of the discharge ports 60B of the liquid distributing unit 60. FIG. 15 is a cross-sectional view (a cross section perpendicular to the W direction) of one ejection head unit 70. As illustrated in FIG. 15, the ejection head unit 70 according to the first embodiment has a head chip in which a pressure chamber forming substrate 72 and a vibrating plate 73 are stacked on one surface of a flow path forming substrate 71 and a nozzle plate 74 and a compliance section 75 are disposed on the other surface of the flow path forming substrate 71. A plurality of the nozzles N are formed in the nozzle plate 74. As understood from FIG. 15, since a structure corresponding to each row of the nozzles N is formed in one ejection head unit 70 substantially in line symmetry, hereinafter, a structure of the ejection head unit 70 will be described focusing on one row of the nozzles N for convenience.

The flow path forming substrate 71 is a flat plate that configures the flow path of the ink I. An opening 712, a supply flow path 714, and a communication flow path 716 are formed in the flow path forming substrate 71 according to the first embodiment. The supply flow path 714 and the communication flow path 716 are formed for each nozzle N and the opening 712 is continuous through the plurality of nozzles N which eject the ink I of one system. The pressure chamber forming substrate 72 is a flat plate on which a plurality of openings 722 corresponding to the different nozzles N are formed. The flow path forming substrate 71 and the pressure chamber forming substrate 72 are formed of, for example, a silicon single-crystal substrate.

The compliance section 75 in FIG. 15 is a mechanism that suppress (absorb) pressure fluctuations in the flow path of the ejection head unit 70 and is configured to have a sealing plate 752 and a support member 754. The sealing plate 752 is a film-like member having flexibility and the support member 754 causes the sealing plate 752 to be fixed to the flow path forming substrate 71 such that the opening 712 and each of the supply flow paths 714 of the flow path forming substrate 71 are closed.

The vibrating plate 73 is disposed on a surface of the pressure chamber forming substrate 72 in FIG. 15, which is on a side opposite to the flow path forming substrate 71. The vibrating plate 73 is a flat plate-shaped member that can vibrate elastically and is configured to stack, for example, an elastic film formed of an elastic material such as oxide silicon and an insulating film formed of an insulating material such as zirconium oxide. As understood from FIG. 15, the vibrating plate 73 and the flow path forming substrate 71 face and are spaced from each other inside each opening 722 formed in the pressure chamber forming substrate 72. A space interposed between the flow path forming substrate 71 and the vibrating plate 73 inside each opening 722 functions as a pressure chamber (cavity) C which applies pressure to the ink. As understood from FIG. 4, a plurality of pressure chambers C are arranged along the W direction.

A plurality of piezoelectric elements 732 corresponding to the different nozzles N are formed on a surface of the vibrating plate 73 which is on a side opposite to the pressure chamber forming substrate 72. Each of the piezoelectric elements 732 is a stacked body in which a piezoelectric body is interposed between electrodes facing each other. The piezoelectric element 732 vibrates along with the vibrating plate 73 when a drive signal is supplied, and thereby pressure in the pressure chamber C is changed and then, the ink I is ejected from the nozzle N. Each of the piezoelectric elements 732 is sealed and protected by a protecting plate 76 which is fixed to the vibrating plate 73.

As illustrated in FIG. 15, the support member 77 is fixed to the flow path forming substrate 71 and the protecting plate 76. The support member 77 is formed integrally by molding of, for example, a resin material. In the support member 77 according to the first embodiment, a space 772, along with the flow path forming substrate 71 an the opening 712, which forms a liquid storage chamber (reservoir) R and a supply port 774 that communicates with the liquid storage chamber R are formed. Each of the supply ports 774 communicates with each of the discharge port 60B of the liquid distributing unit 60. Thus, the inks I of each system obtained after being distributed by the liquid distributing unit 60 is supplied and stored to the liquid storage chamber R from the discharge port 60B via the supply port 774 of the ejection head unit 70. The ink I stored in the liquid storage chamber R is distributed and fills each of the pressure chamber C by the plurality of supply flow paths 714 and passes through the communication flow path 716 and the nozzle N from each pressure chamber C and is ejected to the outside (side of the printing medium M).

As illustrated in FIG. 15, an end of a wiring substrate 78 is joined to the vibrating plate 73. The wiring substrate 78 is a flexible substrate (flexible wiring substrate) on which a wiring for transmitting the drive signal and the supply voltage to each of the piezoelectric elements 732 and passes through an opening (slit) formed in the protecting plate 76 and the support member 77 and protrudes to the side of the wiring substrate 56.

As illustrated in FIG. 10, an opening (slit) 60C corresponding to the wiring substrate 78 of each of the ejection head unit 70 is formed in the liquid distributing unit 60 (the first flow path substrate 62, the second flow path substrate 64, and the third flow path substrate 66). The wiring substrate 78 of each of the ejection head unit 70 passes through each of the openings 60C of the liquid distributing unit 60 and protrudes to the side of the wiring substrate 56 and an end of the wiring substrate 78 opposite to the ejection head unit 70 is connected to wiring substrate 56. The drive signal and the supply voltage are supplied to the piezoelectric element 732 of each of the ejection head units 70 from the wiring substrate 56 via each of the wiring substrates 78.

As illustrated in FIG. 12 to FIG. 14, each of the openings 60C of the liquid distributing unit 60 is formed in a lengthy shape extending in the W direction in a region between the branch qB of each flow path Q1 and the branch qB of each flow path Q1. As described above, according to the first embodiment, since the flexible wiring substrate 78 of the ejection head unit 70 is connected to the wiring substrate 56 via the opening 60C of the liquid distributing unit 60, it is possible to decrease the wiring substrate 78 in size (furthermore, a manufacturing cost is decreased), for example, compared to a configuration in which the wiring substrate 78 is bent and is connected to the wiring substrate 56 so as to pass the outer side of the circumferential edge of the liquid distributing unit 60.

The fixing plate 58 in FIG. 10 is a flat plate formed of a metal with high rigidity such as stainless steel. As illustrated in FIG. 10, six openings 582 corresponding to different ejection head units 70 are formed on the fixing plate 58. Each of the openings 582 is a through-hole of a substantially rectangle which is long in the W direction in a plan view. Each of the ejection head units 70 is fixed to the surface of the fixing plate 58, for example, using an adhesive in a state in which the nozzle plate 74 is positioned inside the opening 582. Each of the liquid ejecting unit U3 according to the first embodiment is configured as above.

As described above, according to the first embodiment, each of the inks I is distributed by the flow path structure G1 and the liquid distributing unit 60. Thus, there is an advantage in that the liquid ejecting head 14 is decreased in size when viewed from the Z direction, compared to a configuration in which the inks I are distributed by a single element to the same number as in the first embodiment.

According to the first embodiment, since the flow path controlling section G2 that controls the opening and closing of the flow path PI2 of each of the inks I and the pressure in the flow path PI2 is disposed between the flow path structure G1 and the liquid distributing unit 60, there is an advantage in that it is possible to reduce a variation of a pressure drop of each of the flow path PI1 in the flow path structure G1, compared to a configuration in which the flow path controlling section G2 is disposed on the upstream side of the flow path structure G1.

According to the first embodiment, since the filter section 52 is disposed between the flow path structure G1 and the liquid distributing unit 60 (on the upstream side of the liquid distributing unit 60), it is possible to reduce a possibility that bubbles or foreign substances flow in the liquid distributing unit 60, for example, compared to a configuration in which the filter section 52 is disposed on the downstream side of the liquid distributing unit 60. In addition, since it is possible to detach the filter section 52 according to the first embodiment from the liquid distributing unit 60, there is an advantage in that it is easy to clean each of the filters 526.

Second Embodiment

A second embodiment according to the invention is described. The reference sign used in the first embodiment is attached to an element which has the same action or function as in the first embodiment according to each embodiment to be described later and thus, detailed description thereof is appropriately omitted.

Figure 16:
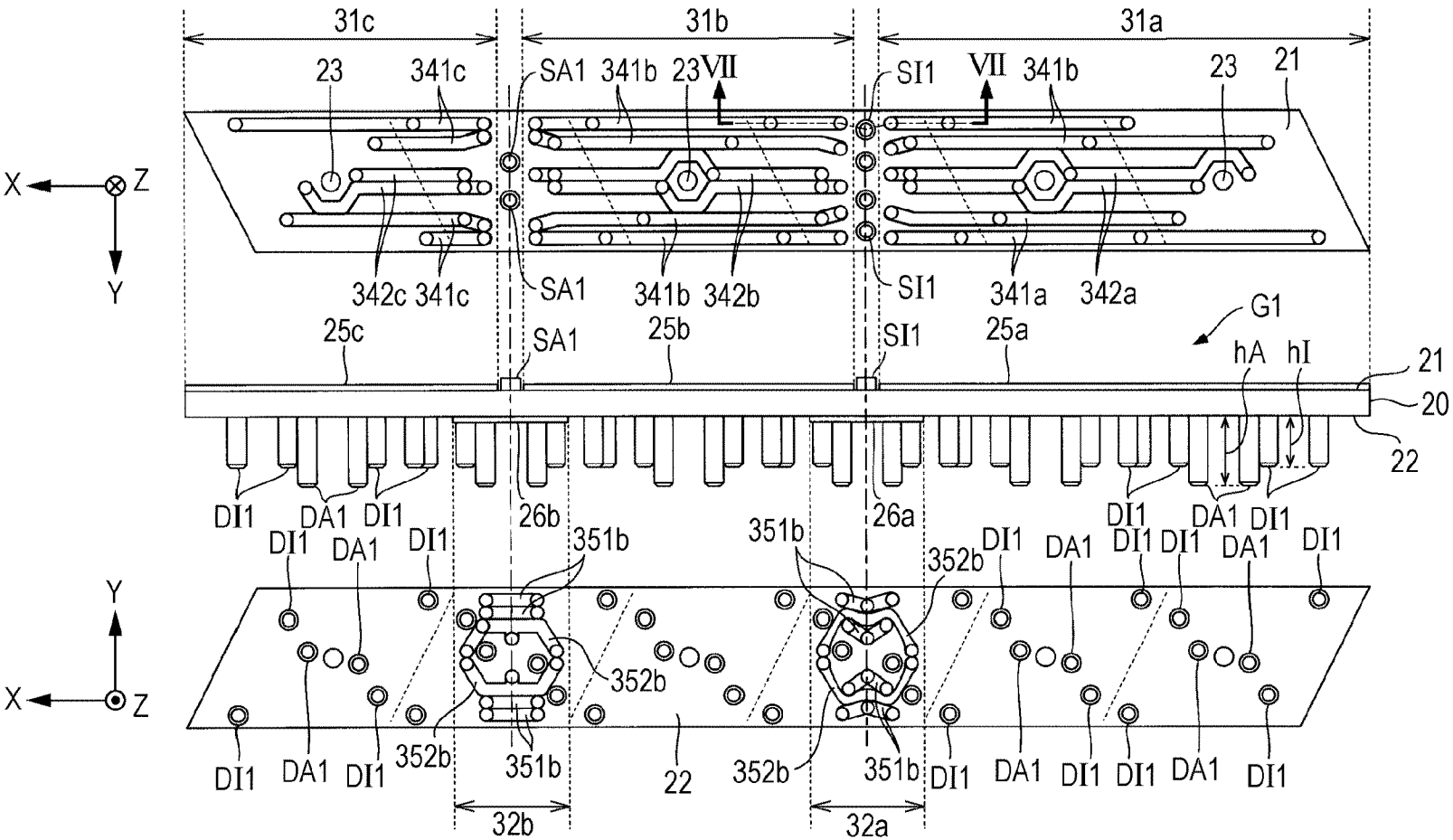
FIG. 16 illustrates side and plan views of a flow path structure according to a second embodiment.

FIG. 16 illustrates side and plan views of the flow path structure G1 according to a second embodiment. According to the first embodiment, the height of each of the circular tube-shaped discharge ports (DI1 and DA1) formed on the second surface 22 is the same. On the second surface 22 of the flow path structure G1 according to the second embodiment, a plurality of types of discharge ports with different heights from each other are formed on the second surface 22. Specifically, as illustrated in FIG. 16, a height hA of the discharge port DA1 of air A is greater than a hI of the discharge port DI1 of each of the inks I. It is possible to employ a configuration in which the height hI of each of the discharge ports DI1 is greater than the height hA of each of the discharge ports DA1.

In the configuration according to the first embodiment in which the discharge ports D (DI1 and DA1) on the second surface 22 have the same height as each other, in a process (an assembly process of the liquid ejecting head 14) of inserting each of the discharge ports D (DI1 and DA1) of the flow path structure G1 into each of the supply ports S (SI2 and SA2) of the flow path controlling section G2, since stress from the entire discharge ports D acts on the flow path controlling section G2 simultaneously, there is a possibility that the flow path controlling section G2 is deformed due to the stress from the flow path structure G1. On the other hand, according to the second embodiment, since the heights of the discharge port DI1 and the discharge port DA1 are different from each other, in the assembly process of the liquid ejecting head 14, a time point at which stress from each of the discharge ports DI1 starts to act on the flow path controlling section G2 is different from a time point at which stress from each of the discharge ports DA1 starts to act on the flow path controlling section G2. That is, time points at which the stress from each of the discharge ports D starts to act on the flow path controlling section G2 are temporally dispersed. Thus, there is an advantage in that it is possible to prevent the flow path controlling section G2 from deformation or damage in the assembly process of the liquid ejecting head 14, compared to the first embodiment.

In the illustration of FIG. 16, the heights of the discharge port DA1 of the air A and the discharge port DI1 of the ink I are different from each other; however, a method of selecting discharge ports D which causes the heights to be different from each other is not limited to the above method. For example, it is possible to employ a configuration in which the heights of the discharge ports DI1 corresponding to the different ink I are different from each other, or a configuration in which the height of each of the discharge ports D (DI1 and DA1) is different for each region obtained by dividing the second surface 22, for example, along the X direction. Further, in terms of relieve concentration of the stress on the flow path controlling section G2, a configuration is preferable, in which the discharge port D with the height hA and the discharge port D of the height hB are distributed in the plane of the second surface 22 substantially at equal intervals. In the illustration of FIG. 16, two types of heights of the discharge ports D are illustrated; however, it is possible to form three or more types of heights of the discharge ports D on the second surface 22.

Third Embodiment

Figure 17:
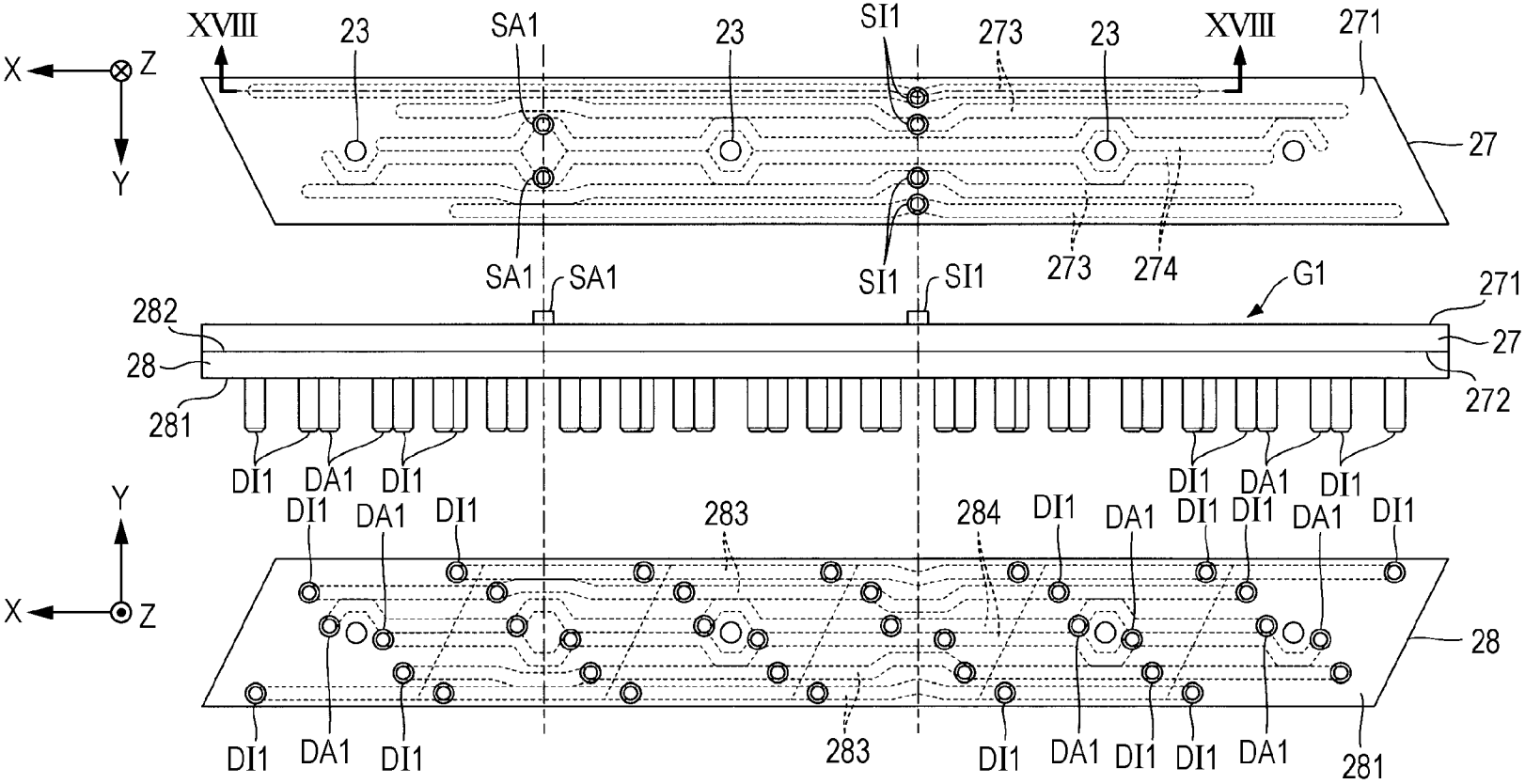
FIG. 17 illustrates side and plan views of a flow path structure according to a third embodiment.
Figure 18:
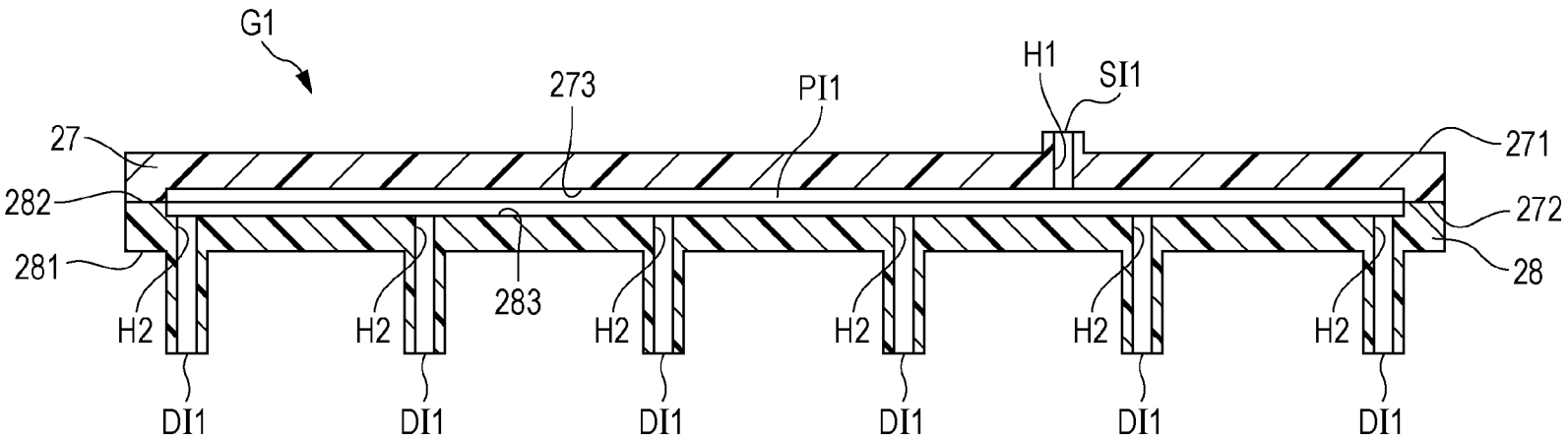
FIG. 18 is a cross-sectional view taken along line XVIII-XVIII in FIG. 17.

FIG. 17 illustrates side and plan views of the flow path structure G1 according to a third embodiment. FIG. 18 is a cross-sectional view (cross section parallel to the X-Z plane) taken along line XVIII-XVIII in FIG. 17. According to the first embodiment, the flow path structure G1 is described, which has a structure in which the film-like sealing portions 25 and the sealing portions 26 are bonded on the substrate 20. As illustrated in FIG. 17, the flow path structure G1 according to the third embodiment is a flat plate-shaped structure which is joined in a state in which the first substrate 27 and the second substrate 28 face each other. The first substrate 27 and the second substrate 28 are flat plate-like members which are long in the X direction similar to the substrate 20 according to the first embodiment is are formed of a thermoplastic resin material such as polypropylene. The first substrate 27 has a first surface 271 on a side opposite to the second substrate 28 and a first flow path surface (surface facing the second substrate 28) 272 on the side opposite to the first surface 271. Similarly, the second substrate 28 has a second surface 281 on a side opposite to the first substrate 27 and a second flow path surface (surface facing the first substrate 27) 282 on the side opposite to the second surface 281.

Similar to the first surface 21 of the substrate 20 according to the first embodiment, on the first surface 271 of the first substrate 27, the four supply ports SI1 to which the inks I (C, M, Y, and K) of each system is supplied from the liquid container 18 and the two supply ports SA1 to which the air A (A1 and A2) of the two systems are supplied from the pump 16 are formed. In addition, similar to the second surface 22 of the substrate 20 according to the first embodiment, on the second surface 281 of the second substrate 28, the four discharge ports DI1 corresponding to the inks I of the systems and the two discharge ports DA1 corresponding to the systems of the air A are formed separately for each of the six liquid ejecting units U3. The six discharge ports DI1 corresponding to the ink I of any one system are arranged substantially at equal intervals in the X direction and the six discharge ports DA1 corresponding to the air A of any one system are arranged substantially at equal intervals in the X direction.

As illustrated in FIG. 17 and FIG. 18, on the first flow path surface 272 of the first substrate 27, four grooves 273 corresponding to the inks I of the systems and two grooves 274 corresponding to the air A of the systems are formed. The grooves 273 and the grooves 274 extend substantially linearly along the X direction substantially over the entire area of a range, in a plan view, in which the six flow path controlling units U2 are arranged. Each of the grooves 273 is formed so as to be overlapped with one supply port SI1 for supplying the ink I in a plan view and communicates with the supply port SI1 via a through-hole H1 formed in the first substrate 27 as understood from FIG. 18. Similarly, each of the grooves 274 is formed so as to be overlapped with one supply port SA1 for supplying the air A in a plan view and communicates with the supply port SA1 via a through-hole H1 formed in the first substrate 27.

On the second flow path surface 282 of the second substrate 28, four grooves 283 corresponding to the inks I of the systems and two grooves 284 corresponding to the air A of the systems are formed. The grooves 283 extend substantially linearly along the X direction so as to be overlapped with six discharge ports DI1 corresponding to the ink I of one system in a plan view and communicates with the discharge ports DI1 via a through-hole H2 formed in the second substrate 28 as understood from FIG. 18. Similarly, each of the grooves 284 extends substantially linearly along the X direction so as to be overlapped with six discharge ports DA1 corresponding to the air A of one system in a plan view and communicates with the discharge ports DA1 via the through-hole H2 formed in the second substrate 28.

The first flow path surface 272 of the first substrate 27 and the second flow path surface 282 of the second substrate 28 are joined to each other such that the grooves 273 and the grooves 283 are overlapped with each other in a plan view and the grooves 274 and the grooves 284 are overlapped with each other in a plan view. In terms of the joining of the first substrate 27 and the second substrate 28, it is possible to employ any known technology such as welding (for example, ultrasonic welding) or adhesion. As illustrated in FIG. 18, in a state in which the first substrate 27 and the second substrate 28 are joined to each other, a space surrounded by an inner circumferential surface of each of the grooves 273 and an inner circumferential surface of each of the grooves 283 functions as the flow path PI1 of the ink I and a space surrounded by an inner circumferential surface of each of the grooves 274 and an inner circumferential surface of each of the grooves 284 functions as the flow path PA1 of the air A.

As understood from the above description, the flow path PI1 communicates with one supply port SI1 and the six discharge ports DI1 and the flow path PA1 communicates with one supply port SA1 and the six discharge ports DA1. Similar to the first embodiment, the four flow paths PI1 (the grooves 273 and the grooves 283) corresponding to the inks I are positioned on both sides between which the two flow paths PA1 (the grooves 274 and the grooves 284) according to the air A are interposed. The configuration, in which the flow paths PA1 (the grooves 273 and the grooves 283) according to the air A are bent so as to bypass the attachment hole 23 in a plan view, is also the same as in the first embodiment. The configuration of each element other than the flow path structure G1 is the same as in the first embodiment.

The same effect as in the first embodiment is realized in the third embodiment. In addition, according to the third embodiment, since the first substrate 27 and the second substrate 28 are joined and thereby, the flow paths PI1 and the flow paths PA1 are formed, there is an advantage in that it is possible to sufficiently maintain mechanical strength of the flow paths PI1 and the flow paths PA1 (it is possible to prevent each flow path from damage), compared to the first embodiment in which the film-like sealing portions 25 and sealing portions 26 are sticked on the substrate 20. On the other hand, according to the first embodiment, since the film-like sealing portions 25 and sealing portions 26 are sticked on the substrate 20 and thereby, the flow paths PI1 and the flow paths PA1 are formed, there is an advantage in that it is easy to achieve the thin flow path structure G1, compared to the third embodiment in which the first substrate 27 and the second substrate 28 are joined. In addition, according to the third embodiment in which the flow paths are formed on the joining surfaces of the first substrate 27 and the second substrate 28, high flatness is not required for the first flow path surface 272 of the first substrate 27 or the second flow path surface 282 of the second substrate 28. However, according to the first embodiment, since the flexible sealing portions 25 and sealing portions 26 are sticked to the substrate 20, there is an advantage in that a condition for the required flatness for the substrate 20 is lowered (it is possible to use an inexpensive substrate 20), compared to the third embodiment.

According to the first embodiment, a structure, in which the substrate 20 and the sealing portions (25 and 26) are stacked, and a structure, in which the first substrate 27 and the second substrate 28 according to the third embodiment are stacked, are comprehensively described as a plate-like structure (substrate) in which flow paths (PI1 and PA1) that causes the supply ports (SI1 and SA1) and the plurality of discharge ports (DI1 and DA1) to communicate with each other. The supply ports (SI1 and SA1) are formed on one surface of the base section and the plurality of discharge ports (DI1 and DA1) are formed on the other surface of the base section.

As described above, although the grooves (273, 274, 283, and 284) are formed in both the first substrate 27 and the second substrate 28, it is possible to form the grooves only one of the first substrate 27 and the second substrate 28. In addition, the configuration according to the second embodiment in which heights of the discharge ports (DI1 and DA1) can be applied also to the third embodiment.

Modification Example

The embodiments described above can be modified in various ways. The aspects of the specific modifications are described as follows. Two or more aspects selected arbitrarily from the following examples can be appropriately combined within a range in which the selected aspects are not incompatible with each other.

(1) According to each embodiment described above, the flow path structure G1 distributes both the ink I and the air A; however, it is possible to use the flow path structure G1 for distributing either one of the ink I or the air A. That is, either the flow path PI1 for distributing the ink I or the flow path PA1 for distributing the air A can be omitted. In addition, according to each embodiment, the flow path controlling section G2 is disposed between the flow path structure G1 and the liquid ejecting section G3; however, a configuration in which the flow path controlling section G2 is omitted or a configuration in which the flow path controlling section G2 is disposed on the upstream side of the flow path structure G1 can be employed. In the configuration in which the flow path controlling section G2 is omitted, the flow path PA1 for distributing the air A is omitted from the flow path structure G1 and each ink I obtained after being distributed by the flow path structure G1 is supplied to the liquid ejecting section G3 (liquid ejecting unit U3).

(2) According to each embodiment described above, the flow path controlling section G2 is configured of the plurality of flow path controlling unit U2 formed separately from each other; however, it is possible to realize the function of the flow path controlling section G2 by a single device. That is, the invention does not necessarily require a configuration in which the flow path controlling section G2 is separated into the plurality of flow path controlling units U2. In addition, according to each embodiment described above, the liquid ejecting section G3 is configured to have the plurality of liquid ejecting units U3 formed separately from each other; it is possible to realize the functions of the liquid ejecting section G3 by a single device. That is, the invention does not necessarily require the configuration in which the liquid ejecting section G3 is separated into the plurality of liquid ejecting unit U3.

(3) According to the first embodiment, the grooves 341 (341*a*, 341*b*, and 341*c*) formed on the first surface 21 of the substrate 20 of the flow path structure G1 communicate with the supply ports SI1 via the grooves 351 (351*a* and 351*b*) of the second surface 22; however, it is possible for the grooves 341 to communicate with the supply port SI1 via the flow path formed inside the substrate 20. That is, the grooves 351 of the second surface 22 can be omitted. Here, in the configuration in which the grooves 351 are formed on the second surface 22 as in each embodiment described above, there is an advantage in that it is possible to easily form the substrate 20, for example, by mold injection, compared to a configuration in which the flow path is formed inside the substrate 20. In the illustration described above, the grooves 341 of the ink I is focused; however, it is possible for the groove to communicate with the supply port SA1 via the flow path formed inside the substrate 20, similar to the grooves 342 for supplying of the air A. As understood from the above description, the configuration according to the first embodiment is described comprehensively as the configuration in which the front-side grooves formed on the first surface 21 communicate with the supply ports (SI1 and SA1) and the configuration in which the front-side grooves communicate with the supply port.

(4) According to the first embodiment, the sealing portions 25 and the sealing portions 26 disposed in the substrate 20 are film-like; however, the shape of the sealing portion 25 and the sealing portion 26 are not limited to the above illustration. For example, it is possible to form the flow paths by sticking a flat plate formed of a resin material on the substrate 20 as the sealing portion 25 and the sealing portion 26. Here, in terms of reducing a thickness of the flow path structure G1, it is preferable that the configuration is employed, in which the thickness of the sealing portion 25 and the sealing portion 26 is greater than the thickness of the substrate 20.

(5) The element that ejects ink from the nozzles N is not limited to the piezoelectric element 732 described above. For example, it is possible to use a light emitting element that ejects the ink from the nozzles N by generating the bubbles by heating and changing the pressure in the pressure chamber C instead of the piezoelectric element 732. The piezoelectric element 732 or the light emitting element are comprehensively described as an element (pressure generating element) that changes the pressure inside the pressure chamber C and, according to the invention, a method (piezo method/thermal method) that changes the pressure or any specific configuration may be employed.

(6) The printing apparatus 100 illustrated in each embodiment described above is not only an apparatus dedicated to printing, but also can employ a various apparatuses such as a facsimile machine or a copy machine. Further, the usage of the liquid ejecting apparatus according to the invention is not limited to printing. For example, the liquid ejecting apparatus that ejects a solution with color is used as a manufacturing apparatus that forms a color filter of the liquid crystal display apparatus. In addition, the liquid ejecting apparatus that ejects a solution of a conductive material is used as a manufacturing apparatus that forms a wiring or electrode on the wiring substrate.

What is claimed is:

1. A liquid ejecting apparatus comprising:

a first liquid ejecting unit and a second liquid ejecting unit, the first liquid ejecting unit and the second liquid ejecting unit respectively comprising:

a first supply port, to which an ink of a first system is supplied;

a second supply port, to which an ink of a second system that is different from the ink of the first system is supplied;

a liquid distributing unit that distributes the ink of the first system and the ink of the second system, and that includes a first flow path substrate, a second flow path substrate, and a third flow path substrate, the first flow path substrate, the second flow path substrate, and the third flow path substrate being stacked in a first direction;

a filter section including a plurality of filters through which the ink of the first system and the ink of the second system pass; and a first ejection head unit and a second ejection head unit, wherein the ink of the first system and the ink of the second system are supplied from the liquid distributing unit to the first and second ejection head units; wherein the second flow path substrate has a through-hole through which the ink of the first system passes, and a first flow path that distributes the ink of the second system and that is located between the first flow path substrate and the second flow path substrate, the third flow path substrate has a through-hole through which the ink of the second system passes, and a second flow path that distributes the ink of the first system and that is located between the second flow path substrate and the third flow path substrate, the first flow path and the second flow path are partially overlapped with each other in a plan view, and the liquid distributing unit is disposed between the first ejection head unit and the filter section.

2. A liquid ejecting apparatus according to claim 1,
wherein the first liquid ejecting unit and the second liquid ejecting unit are arranged in a second direction, and
wherein the first liquid ejecting unit and the second liquid ejecting unit, as viewed from a direction orthogonal to both the first direction and the second direction, are partially overlapped with each other.

3. A liquid ejecting apparatus according to claim 1, wherein
the second flow path substrate includes a groove, the first flow path is formed by the first flow path substrate closing the groove of the second flow path substrate, and
the third flow path substrate includes a groove, the second flow path is formed by the second flow path substrate closing the groove of the third flow path substrate.

4. A liquid ejecting apparatus according to claim 1, wherein the filter section and the liquid distributing unit are detachably fixed to each other.

5. A liquid ejecting apparatus according to claim 1, further comprising:
a flow path structure that distributes each of the ink of the first system and the ink of the second system into each of the first liquid ejecting unit and the second liquid ejecting unit,
wherein the filter section is disposed between the flow path structure and the liquid distributing unit.

6. A liquid ejecting apparatus according to claim 1, further comprising:
a flow path structure that distributes each of the ink of the first system and the ink of the second system into each of the first liquid ejecting unit and the second liquid ejecting unit,
wherein a rigidity of the liquid distributing unit is greater than a rigidity of the flow path structure.

7. A liquid ejecting apparatus according to claim 5, further comprising:
a wiring substrate that forms a wiring that transmits a drive signal to the first and second ejection head units, and that is disposed between the flow path structure and the liquid distributing unit.

8. A liquid ejecting apparatus according to claim 5, further comprising:
a flow path controlling section that controls the flow paths of the ink of the first system and the ink of the second system which are distributed by the flow path structure, and that is disposed between the flow path structure and the liquid distributing unit.

9. A liquid ejecting apparatus according to claim 5, further comprising:
a casing that supports the first and the second liquid ejecting units, and that is disposed between the flow path structure and the liquid distributing unit.

10. A liquid ejecting apparatus according to claim 5, wherein
the flow path structure includes a plate-shaped substrate, a supply port formed on one surface of the plate-shaped substrate, a plurality of discharge ports formed on another surface of the plate-shaped substrate, and
the plate-shaped substrate is formed a flow path in communicating the supply port with the plurality of discharge ports.

11. A liquid ejecting apparatus according to claim 1, wherein
the first and second liquid ejecting units have a fixing plate to which are fixed the first and second ejection heads, and
the fixing plate is formed of a plurality of openings corresponding to a plurality of nozzles of each of the first and second ejection heads.

12. A liquid ejecting apparatus according to claim 1, wherein the ink of the first system and the ink of the second system are inks of different colors.

13. A liquid ejecting apparatus comprising:
a first liquid ejecting unit and a second liquid ejecting unit, the first liquid ejecting unit and the second liquid ejecting unit respectively comprising:
a first supply port, to which an ink of a first system is supplied;
a second supply port, to which an ink of a second system that is different from the ink of the first system is supplied;
a liquid distributing unit that distributes the ink of the first system and the ink of the second system, and that includes a first flow path substrate, a second flow path substrate, and a third flow path substrate, the first flow path substrate, the second flow path substrate, and the third flow path substrate being stacked in a first direction; and
a first ejection head unit and a second ejection head unit, wherein the ink of the first system and the ink of the second system are supplied from the liquid distributing unit to the first and second ejection head units; wherein
the second flow path substrate has a through-hole through which the ink of the first system passes, and a first flow path that distributes the ink of the second system and that is located between the first flow path substrate and the second flow path substrate,
the third flow path substrate has a through-hole through which the ink of the second system passes, and a second flow path that distributes the ink of the first system and that is located between the second flow path substrate and the third flow path substrate,
the first flow path and the second flow path are partially overlapped with each other in a plan view,
the first liquid ejecting unit and the second liquid ejecting unit are arranged in a second direction, and
the first liquid ejecting unit and the second liquid ejecting unit, as viewed from a direction orthogonal to both the first direction and the second direction, are partially overlapped with each other.

14. A liquid ejecting apparatus according to claim 13, wherein
the second flow path substrate includes a groove, the first flow path is formed by the first flow path substrate closing the groove of the second flow path substrate, and
the third flow path substrate includes a groove, the second flow path is formed by the second flow path substrate closing the groove of the third flow path substrate.

15. A liquid ejecting apparatus according to claim 13, wherein
the first and second liquid ejecting units have a fixing plate to which are fixed the first and the second ejection heads, and
the fixing plate is formed of a plurality of openings corresponding to a plurality of nozzles of each of the first and second ejection heads.

16. A liquid ejecting apparatus according to claim 13, wherein the ink of the first system and the ink of the second system are inks of different colors.

17. A liquid ejecting apparatus comprising:

a first liquid ejecting unit and a second liquid ejecting unit, the first liquid ejecting unit and the second liquid ejecting unit respectively comprising:

a first supply port, to which an ink of a first system is supplied;

a second supply port, to which an ink of a second system that is different from the ink of the first system is supplied;

a liquid distributing unit that distributes the ink of the first system and the ink of the second system, and that includes a first flow path substrate, a second flow path substrate, and a third flow path substrate, the first flow path substrate, the second flow path substrate, and the third flow path substrate being stacked in a first direction; and a first ejection head unit and a second ejection head unit, wherein the ink of the first system and the ink of the second system are supplied from the liquid distributing unit to the first and second ejection head units; wherein the second flow path substrate has a through-hole through which the ink of the first system passes, and a first flow path that distributes the ink of the second system and that is located between the first flow path substrate and the second flow path substrate, the third flow path substrate has a through-hole through which the ink of the second system passes, and a second flow path that distributes the ink of the first system and that is located between the second flow path substrate and the third flow path substrate, the first flow path and the second flow path are partially overlapped with each other in a plan view, the second flow path substrate includes a groove, the first flow path is formed by the first flow path substrate closing the groove of the second flow path substrate, and the third flow path substrate includes a groove, the second flow path is formed by the second flow path substrate closing the groove of the third flow path substrate.

18. A liquid ejecting apparatus according to claim 17, wherein the first and second liquid ejecting units have a fixing plate to which are fixed the first and the second ejection heads, and the fixing plate is formed of a plurality of openings corresponding to a plurality of nozzles of each of the first and second ejection heads.

19. A liquid ejecting apparatus according to claim 17, wherein the ink of the first system and the ink of the second system are inks of different colors.

* * * * *